US010596477B1

(12) United States Patent
Whipple, Jr. et al.

(10) Patent No.: US 10,596,477 B1
(45) Date of Patent: Mar. 24, 2020

(54) SIMPLY CONSTRUCTED AND COMPACT TRAVERSE AND ELEVATION MECHANISM AND A TOY ROBOT USING SAME

(71) Applicant: Hasbro, Inc., Pawtucket, RI (US)

(72) Inventors: Christopher Whipple, Jr., Exeter, RI (US); Steven Unruh, Cranston, RI (US); Matthieu Dora, Rochester, NY (US)

(73) Assignee: HASBRO, INC., Pawtucket, RI (US)

( * ) Notice: Subject to any disclaimer, the term of this patent is extended or adjusted under 35 U.S.C. 154(b) by 234 days.

(21) Appl. No.: 15/670,781

(22) Filed: Aug. 7, 2017

Related U.S. Application Data

(60) Provisional application No. 62/437,446, filed on Dec. 21, 2016, provisional application No. 62/377,949, filed on Aug. 22, 2016.

(51) Int. Cl.

| | |
|---|---|
| ***A63H 29/22*** | (2006.01) |
| ***A63H 33/26*** | (2006.01) |
| ***A63H 17/00*** | (2006.01) |
| ***A63H 33/00*** | (2006.01) |
| ***A63H 31/00*** | (2006.01) |
| ***A63H 30/04*** | (2006.01) |

(52) U.S. Cl.
CPC ..... *A63H 29/22* (2013.01); *A63H 17/00* (2013.01); *A63H 30/04* (2013.01); *A63H 31/00* (2013.01); *A63H 33/005* (2013.01); *A63H 33/26* (2013.01)

(58) Field of Classification Search
CPC ..... A63H 11/00; A63H 17/00; A63H 17/004; A63H 17/26; A63H 29/22; A63H 31/00; A63H 31/04; A63H 33/005; A63H 33/26; B62D 61/00; G05D 1/0022; G05D 1/0038
See application file for complete search history.

(56) References Cited

U.S. PATENT DOCUMENTS

| | | | | |
|---|---|---|---|---|
| 561,777 | A | 6/1896 | Essberger et al. | |
| 4,272,918 | A * | 6/1981 | Inoue | A63H 31/00 446/175 |
| 4,589,174 | A | 5/1986 | Allen | |
| 4,601,675 | A | 7/1986 | Robinson | |
| 5,533,921 | A | 7/1996 | Wilkinson | |
| 5,676,582 | A * | 10/1997 | Lin | A63H 33/005 446/130 |
| 5,865,661 | A | 2/1999 | Cyrus et al. | |
| 5,984,757 | A | 11/1999 | Tsai | |
| 6,056,619 | A | 5/2000 | Wiggs et al. | |
| 6,824,441 | B1 | 11/2004 | Wiggs et al. | |
| 7,798,050 | B2 | 9/2010 | Sembtner | |
| 8,269,447 | B2 | 9/2012 | Smoot et al. | |

(Continued)

FOREIGN PATENT DOCUMENTS

CN 201220111 U 4/2009

*Primary Examiner* — Eugene L Kim
*Assistant Examiner* — Alyssa M Hylinski
(74) *Attorney, Agent, or Firm* — Perry Hoffman

(57) ABSTRACT

A traverse and elevation mechanism and a toy robot using the mechanism. The mechanism is placed in a rollable spherical housing and includes two cams and cam follower that adjust radial and angular positions of an internal magnetic element. The internal magnetic element is magnetically attracted to an external magnetic element such that movement of the internal magnetic element moves the external magnetic element.

20 Claims, 28 Drawing Sheets

(56) References Cited

U.S. PATENT DOCUMENTS

| | | | | |
|---|---|---|---|---|
| 8,662,955 | B1 * | 3/2014 | Fai | A63H 13/02 446/268 |
| 9,090,214 | B2 | 7/2015 | Bernstein et al. | |
| 10,101,739 | B2 * | 10/2018 | Clarke | G05D 1/0225 |
| 2011/0014848 | A1 | 1/2011 | Law | |
| 2014/0345957 | A1 * | 11/2014 | Bernstein | B60R 11/00 180/21 |
| 2015/0224941 | A1 * | 8/2015 | Bernstein | G05D 1/0022 180/167 |
| 2017/0269589 | A1 * | 9/2017 | Clarke | G05D 1/0225 |

* cited by examiner

Start in Center

Motor clockwise to change radius

Motor counterclockwise to change angle

Finish Position

SIMPLY CONSTRUCTED AND COMPACT TRAVERSE AND ELEVATION MECHANISM AND A TOY ROBOT USING SAME

PRIORITY CROSS-REFERENCE TO RELATED APPLICATION

This application claims priority pursuant to 35 U.S.C. §§ 119, 120 from U.S. provisional application Nos. 62/377,949 and 62/437,446 incorporated herein.

FIELD OF THE INVENTION

The present invention relates generally to a traverse and elevation mechanism and a toy, and more particularly, to a compact and lightweight traverse and elevation mechanism and a toy robot using the same, where the traverse and elevation mechanism is simple, inexpensive and robust, ideally suited for a toy.

BACKGROUND OF THE INVENTION

Traverse and elevation mechanisms and other devices for controlling the movement of a first object relative to a second object have long been known in multiple fields. As an early example of such devices, reference is made to U.S. Pat. No. 561,777, issued in 1896 to Essberger and Geyer for an Electrical Apparatus For Controlling Motion Of Cranes, etc., which purports to disclose a crane being rotatable around a vertical axis using a first motor m and gears $w^1$, $w^2$, t and Z and a vertical load lifting apparatus using a second motor M and gears K, k. Another example is a Polar Coordinate Apparatus patented in the U.S. Pat. No. 4,589,174 in 1986 and issued to Allen. The Allen patent purports to disclose a computer controlled machine tool having a three-dimensional work piece 12 on a turret 100 that is rotatable and translatable by motors 112, 120. A tool or working implement 90 is connected to a radial arm 70, which is movable, by motors 80, 89 where the radial arm is movable along an arcuate track 30 by another motor 52. Yet another motor 98 is used to accomplish control of the implement's depth movement. Positioning the work piece 12 and independently positioning of the implement 90 allows for a wide variety of different operations by the implement on the work piece.

Another recent example of a traverse and elevation mechanism, this for a gun or missile tube, is found in U.S. Pat. No. 7,798,050, issued to Sembtner in 2010 for a Quick-Response Drive Mechanism For Controlling The Movement Of An Object Relative To A Support, and purports to describe a gun or missile tube having traverse and elevation movements which are controlled by search and tracking radar. The mechanism includes a first power train having a motor 10, a pinion 2, an intermediate gear 4, and a shaft 14 for rotating a horizontal gear 6. A second power train includes a motor 9, a pinion 1, an intermediate gear 3, and a tubular shaft 13 for rotating a horizontal gear 5. A third gear 7 is connected to an output shaft 16 and meshes with one or both gears 5, 6 to form a differential-like mechanism wherein the first and second power train may be selectively operated to controllably and cooperatively move the output shaft to a desired position relative to a support structure.

A toy example is illustrated in U.S. Pat. No. 9,090,214 and a CIP Patent Application Publication US2015/0224941, issued to or listing Bernstein and others in 2015 and published in 2015, respectively, and entitled, respectively, Magnetically Coupled Accessory For A Self-Propelled Device and Self Propelled Device With Magnetic Coupling. The patent and application publication purport to disclose a rolling spherical housing 302 having an internal drive system 301, such as one having two wheels 318, 320 powered by two motors 322, 324. The wheels bear against an inner surface 304 of the housing to transfer the motion of the wheels to the housing to cause the housing to roll along a surface. A biasing mechanism 315 including a spring 312 bears against the inner surface of the housing at a location diametrically opposed to the wheels of the drive system to bias the wheels with sufficient force to prevent wheel slippage. A computer control is found in carrier 314 that is powered by a battery 316. A magnetic coupling may be made between an end of the spring 312 and a magnet 332 in an accessory 330 exterior of the spherical housing such that the accessory 330 is maintained on the exterior of the housing even when the housing is in a rolling mode, and movement of the spring end causes the accessory to move accordingly. A rolling cylinder 350 is also disclosed in the application publication.

Another toy patent, this from China, Patent Publication No. CN 201220111Y, published in 2009, purports to also describe a remote controlled toy rolling ball device having an internal drive with three wheels 12, 18, 18 two of which are powered by motors 9, 9. A swing link 15 is pivotally connected to a frame 10 and at the end of the link is a tray 4 to which is mounted magnets 16 that communicated with a magnet 2 in a mobile body 1 mounted on the outside of the ball. Two rotating disks 7 with connecting bars 11 cause the swing link 15 to move that results in the mobile body mimicking the move.

It may now be understood that the devices of the prior art are generally large, heavy, overly complicated and expensive, and not suited for many applications.

SUMMARY OF THE INVENTION

The following disclosure describes in detail a compact, efficient and robust mechanism and a toy for using the mechanism, where the mechanism enables the movement of a first magnetic element along an inner surface of a spherical housing, the first magnetic element for moving a second magnetic element along an outside surface of the spherical housing, wherein movement of the mechanism is accomplished by just a single motive source rotating in first and second directions. Control is found in a hand held control housing with finger controlled switches and an RC transmitter. An RC receiver in the spherical housing receives instructions for the mechanism as well as a drive apparatus also mounted in the spherical housing for rolling the housing along a surface. Instructions are transmitted by an operator to move the first magnetic element within a region of the inside of the spherical housing which results in the second magnetic element moving along a similar region on the outside surface of the spherical housing. Not only is the mechanism compact, efficient and robust, but also the mechanism is lightweight, simply constructed and inexpensive.

Briefly summarized, the invention relates to a traverse and elevation mechanism including a first rotatable cam mounted in a housing, a second rotatable cam mounted in the housing concentric with the first rotatable cam, a cam follower operatively connected to the first rotatable cam, a structural element mounted to the cams radially and angularly adjustable by selective movements of the cams, a transmission mounted in the housing, the transmission for selectively engaging the first and second rotatable cams to enable the first and second rotatable cams to rotate, a single reversible motor connected to the rotatable cams through the transmission for selectively rotating one cam in a first directions and both cams in a second direction, and a control housing for mounting communication equipment operable to selectively activate the motor.

The invention also includes a toy robot apparatus having the traverse and elevation mechanism, the toy robot including a spherical housing having interior and exterior surfaces, a first rotatable cam mounted in the housing, the first rotatable cam having a raceway in a side surface, a cam follower operatively mounted to the raceway of the first rotatable cam, a second rotatable cam mounted in the housing concentric with the first rotatable cam, the second rotatable cam having a radially directed slot, a structural element mounted to move in the slot, the structural element including an internal magnetic element pivotally mounted and located adjacent to the interior surface of the housing, the structural element including a linkage connecting the first and second cams and the internal magnetic element, an arcuate track mounted within the spherical housing for supporting the internal magnetic element, a transmission mounted in the spherical housing, the transmission engaging the first and second cams for selectively rotating the first and second cams, a single reversible motor for operating the transmission by selectively rotating in a first direction and in a second direction, an external magnetic element movable along the exterior surface of the spherical housing magnetically attracted to the internal magnetic element wherein movement of the internal magnetic element along the interior surface of the spherical housing causes movement of the external magnetic element about the exterior surface of the spherical housing, and a control housing for mounting communication equipment operable to selectively activate the reversible motor.

The invention also relates to a method for assembling a toy robot including the steps of providing a spherical housing having interior and exterior surfaces, mounting a first rotatable cam in the spherical housing, the first rotatable cam having a raceway in a side surface and gear teeth on a periphery, mounting a cam follower in the raceway of the first rotatable cam, mounting a second rotatable cam in the spherical housing concentric with the first rotatable cam, pivotally connecting an internal magnetic element to the first and second cam followers, the internal magnetic element being located adjacent to the interior surface of the spherical housing, providing an external magnetic element for mounting to the exterior surface of the spherical housing, the external magnetic element being enabled to magnetically engage with the internal magnetic element, mounting a transmission in the spherical housing for engaging the first and second rotatable cams, mounting a single motor to the transmission for operating the transmission by selectively rotating the first rotatable cam in a first rotational direction and rotating both of the first and second rotatable cams simultaneously in an opposite second rotational direction, and providing a control housing for mounting communication equipment operable to selectively activate the single motor.

BRIEF DESCRIPTION OF THE DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
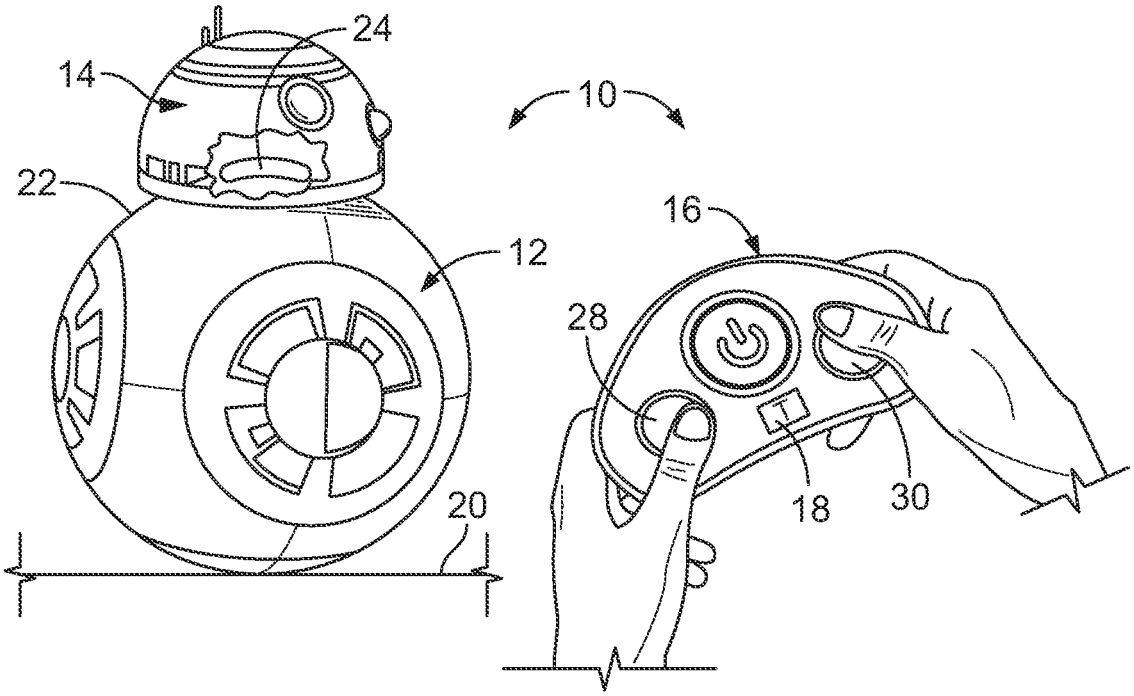
FIG. 1 is an isometric view of a toy BB-8 robot, partially broken away, having a spherical housing, a magnetically coupled appendage and a remote RC control housing.
Figure 10:
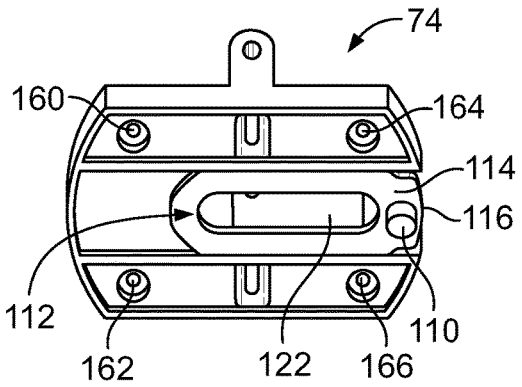
FIG. 10 is an upward looking isometric view of the linkage shown in FIG. 9.

Referring to FIG. 1, there is illustrated an embodiment of the present invention in the form of a toy robot or action FIG. 10 having a rotatable spherical housing or body 12 with an independently movable appendage, head or accessory 14. In this form the toy robot 10 is designed to mimic a robot depicted in the movie STAR WARS: THE FORCE AWAKENS® and is referred to in the movie as BB-8®. A remote control housing 16 having communication equipment such as a remote control (RC) transmitter 18 may be used by an operator to move the toy robot 10 along a surface 20 in a rolling motion all the while maintaining the appendage 14 on an exterior surface 22 of the upper portion of the spherical housing 12 regardless of the attitude of the spherical housing. An RC receiver (shown in FIG. 2) is mounted in the spherical housing and may, through motors and wheels, drive the toy robot 10.

As will be explained below in more detail, the appendage 14 includes one or more external magnetic elements, such as the magnet 24, attracted to one or more magnetic elements located adjacent an interior surface 26, FIG. 2, of the spherical housing 12. The magnetic elements in the spherical housing 12 are connected to a traverse and elevation mechanism that is also packaged in the spherical housing where the traverse and elevation mechanism may be controlled by manipulating control switches 28, 30, FIG. 1, on the remote control housing 16. The operator is able to move the appendage 14 around the upper portion of the spherical housing 12 by moving the magnetic elements within the spherical housing 12. At the same time, the operator may be remotely causing the toy robot to roll along the surface 20, or the operator may maintain the robot in a stationary position. A clever operator may be able to do tricks by moving the spherical housing 12 and the appendage 14 independently or by developing other entertaining movements to enhance play value of the toy robot 10. In the alternative, other control elements may be attached to the control housing 16.

Figure 2:
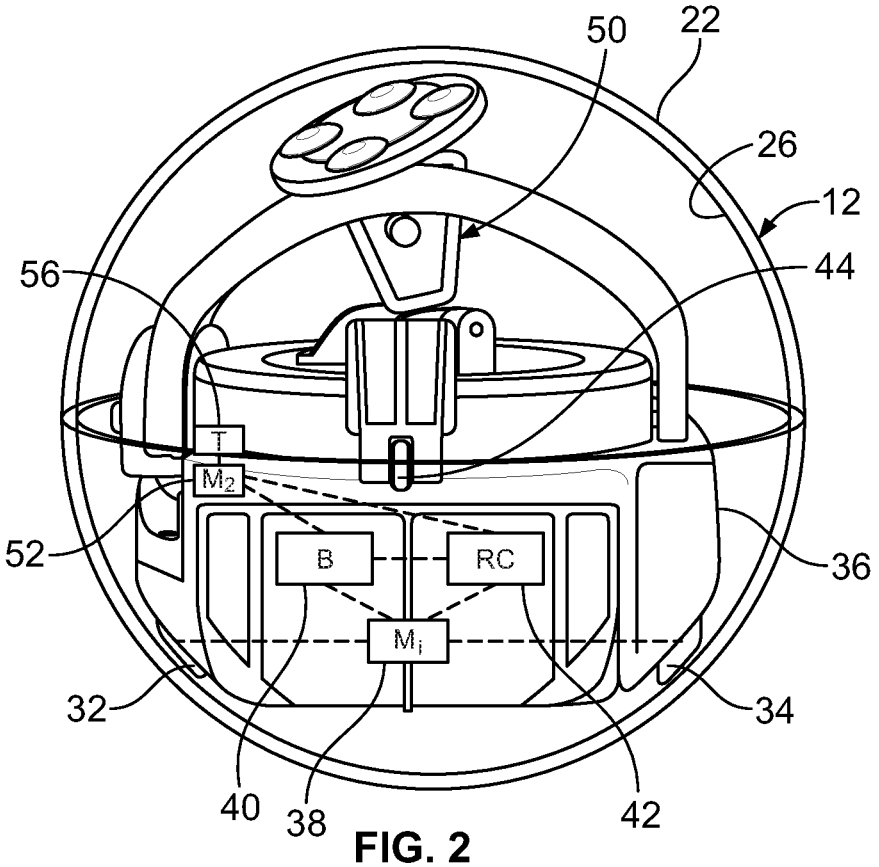
FIG. 2 is an isometric front view of a traverse and elevation mechanism of the present invention and a drive apparatus, all within the spherical housing shown in FIG. 1.
Figure 3:
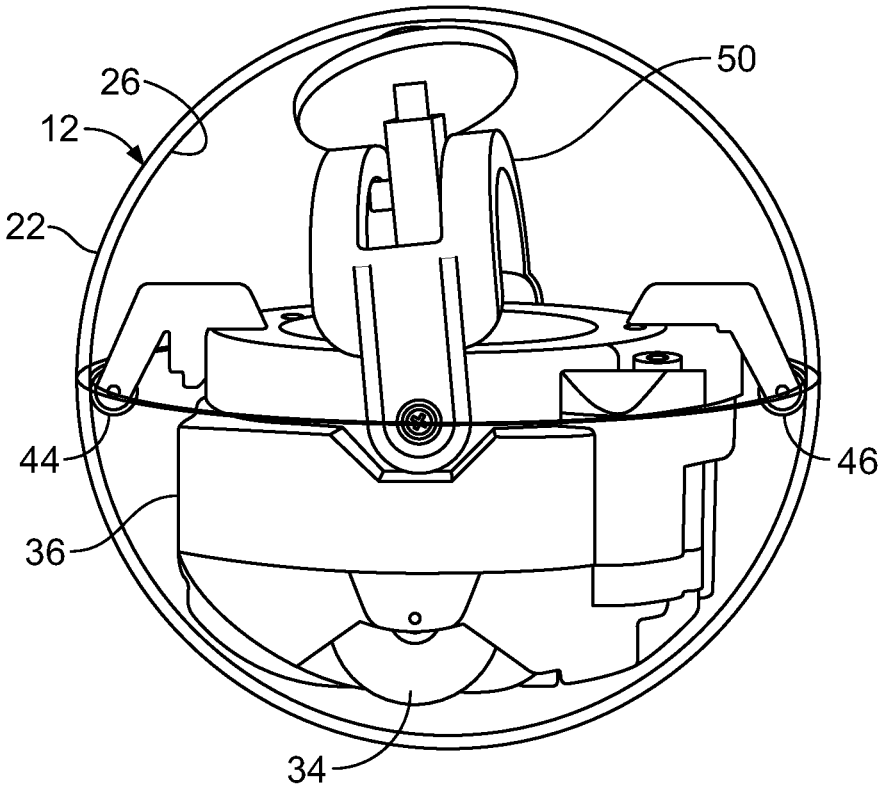
FIG. 3 is an isometric side view of the traverse and elevation mechanism and the drive apparatus shown in FIG. 2.

Referring now to FIGS. 2 and 3, components inside the spherical housing 12 are shown in detail. A set of wheels 32, 34 mounted to a receptacle 36, bear against the interior surface 26 of spherical housing 12 to move the internal components around the interior surface 26. The wheels 32, 34 are driven motors depicted diagrammatically as $M_1$ 38 mounted in the receptacle 36. The receptacle may also hold a battery compartment 40 for one or more batteries to power the wheels 32, 34 and an RC receiver 42, both also depicted diagrammatically, and also mounted in the receptacle 36. The RC receiver 42, which is connected to the battery compartment 40 and the drive motors 38, allows the operator to control the wheels 32, 34. The receptacle 36 also includes two or more side arm rollers, such as the rollers 44, 46, to help stabilize the receptacle 36 and facilitate its movement in the spherical housing. Mounted atop and partially within the receptacle 36 is a traverse and elevation mechanism 50 operated by a second, reversible motor, shown diagrammatically as $M_2$ 52, and powered by a battery or batteries in the battery compartment 40 and controlled by signals received by the RC receiver 42. The traverse and elevation mechanism may include a transmission 56 to transfer motion from the reversible motor 52 to the remainder of the traverse and elevation mechanism 50.

Figure 4:
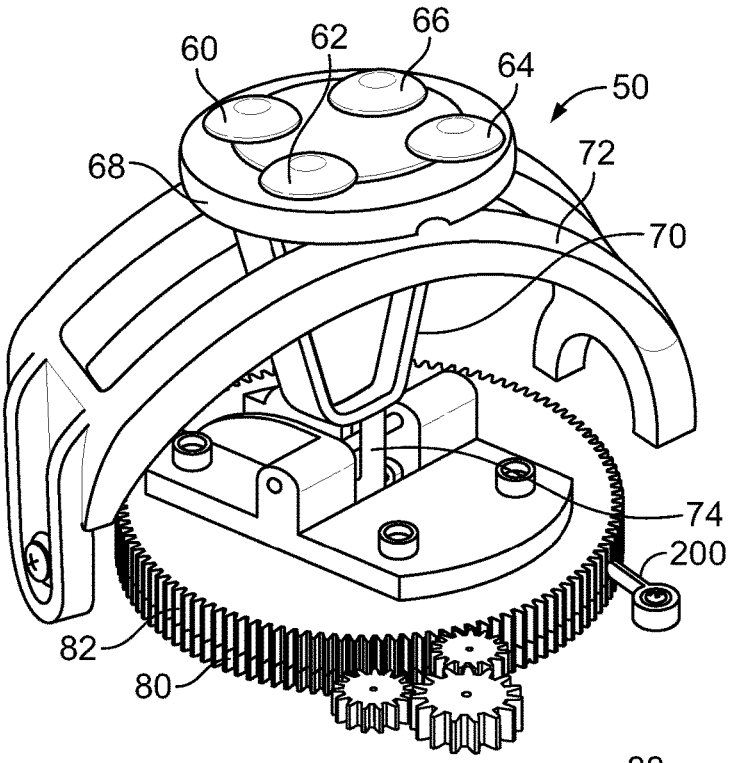
FIG. 4 is an isometric view of the traverse and elevation mechanism shown in FIGS. 2 and 3.

The traverse and elevation mechanism 50, FIG. 4, may also include four magnetic elements 60, 62, 64, 66 mounted to a dome 68. The dome is supported by a base 70 and supported by an arcuate track 72. The base 70 is connected to a linkage 74 that is movable by two cams 80, 82 and a cam follower to be described in detail below. The assembly of the dome, the base and the linkage may together be referred to as a structural element because the assembly may be designed in numerous different ways. In an alternative, the dome may mount any convenient number of magnetic elements, and may assume other shapes, such as a generally rectangular shape.

Figure 5:
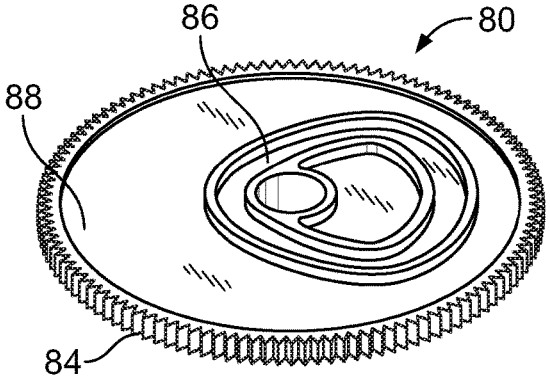
FIG. 5 is an isometric view of a lower cam of the traverse and elevation mechanism, the lower cam with a side surface having a raceway.
Figure 6:
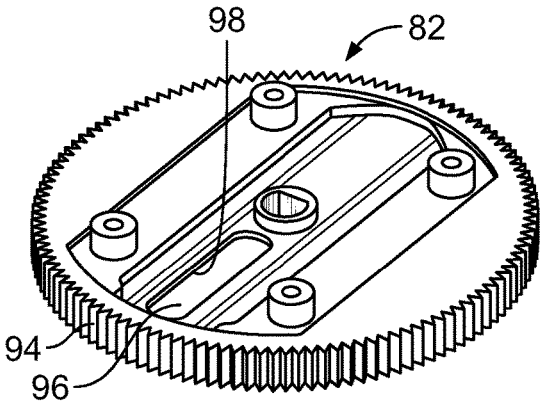
FIG. 6 is an isometric view of a first surface of an upper cam of the traverse and elevation mechanism.
Figure 7:
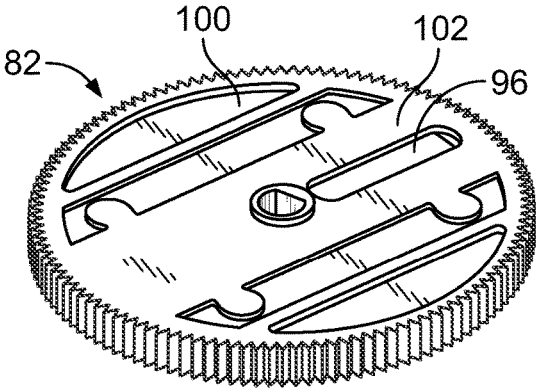
FIG. 7 is an isometric view of a second surface of the upper cam shown in FIG. 6.
Figure 16:
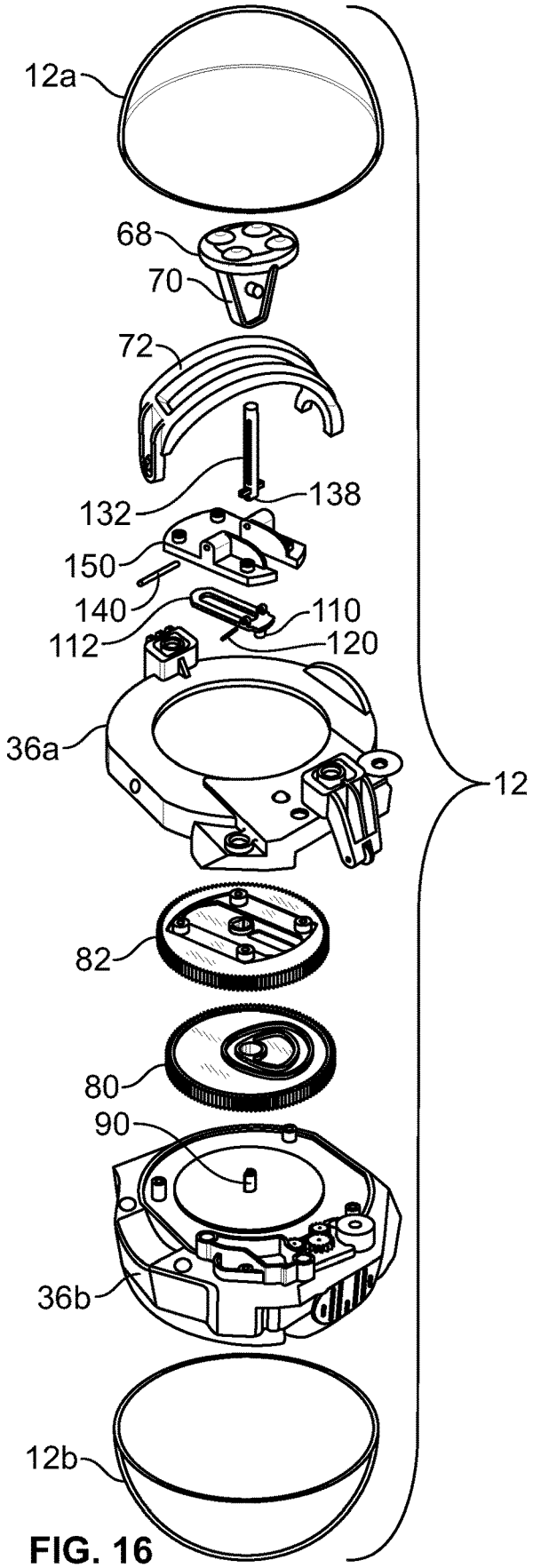
FIG. 16 is an exploded isometric view of the traverse and elevation mechanism in the spherical housing.
Figure 17:
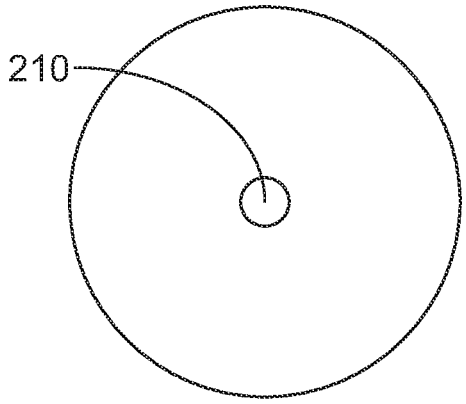
FIG. 17 is a diagrammatic plan view of the internal magnetic element at a radial limit at about the center of the rotatable cams.
Figure 18:
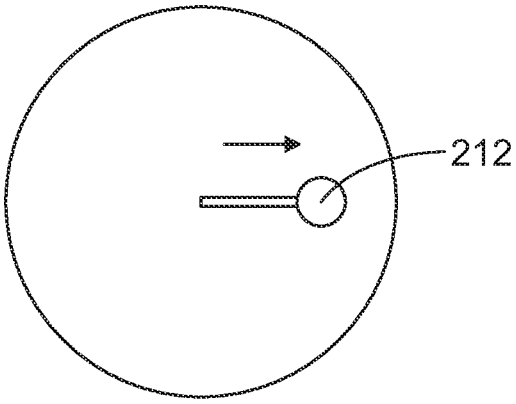
FIG. 18 is a diagrammatic plan view of the internal magnetic element at a radial limit near the periphery of the rotatable cams causing the internal magnetic element to be at a "full tilt" position.

The first or lower rotatable cam 80, FIG. 5, may take the form of a circular gear with a periphery of gear teeth 84 and a raceway 86 in a generally planar side surface 88, which generally faces upward, and is mounted around a rotatable receptacle shaft 90, FIG. 16. The second or upper rotatable cam 82, FIGS. 6 and 7, is mounted concentric with the lower rotatable cam 80 as shown in FIG. 4. The upper rotatable cam 82, may also take the form of a circular gear with a periphery of gear teeth 94 and mount to the receptacle shaft. The upper rotatable cam 82 includes a radially directed slot 96 with a bordering wall 98. An underside 100 of the upper rotatable cam 82, shown in FIG. 7, may include a flat surface 102 to allow unobstructed independent rotation of the cams 80, 82. In the alternative, the cams may have other shapes, be without gear teeth, and may be driven by a belt drive.

Figure 8:
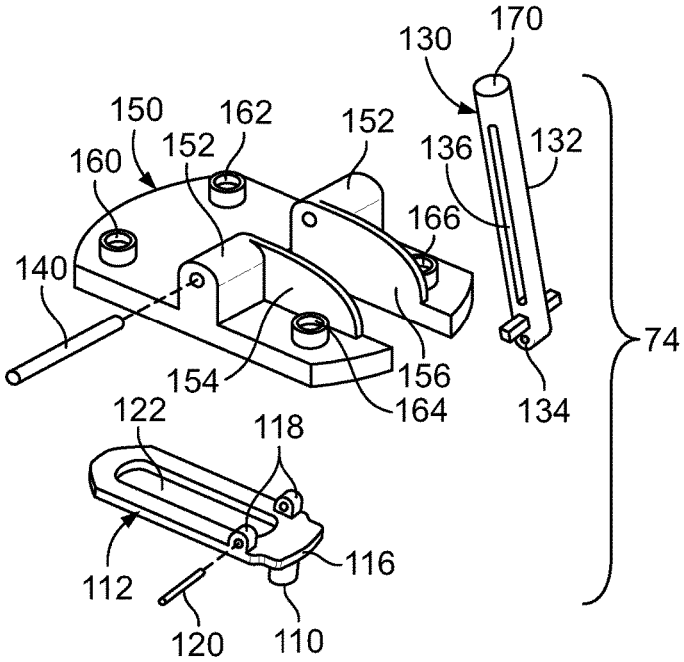
FIG. 8 is an exploded isometric view of a linkage of the traverse and elevation mechanism.
Figure 9:
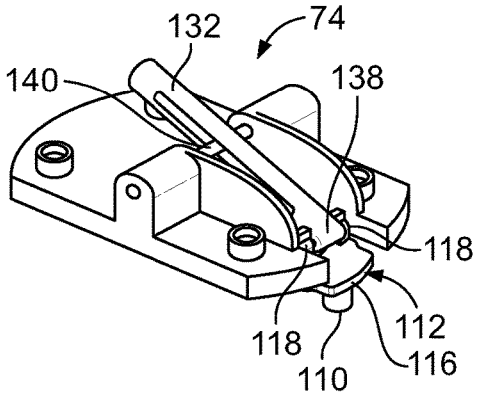
FIG. 9 is an unexploded isometric view of the linkage shown in FIG. 8.

The traverse and elevation mechanism 50 also includes a cam follower 110, FIGS. 8-10, mounted to a follower support 112. The cam follower 110 engages with the lower cam 80 by being movable in the raceway 86. As the lower cam 80 rotates, the cam follower 110 traces the raceway's path causing the follower support 112 to move back and forth in a radial direction relative to the upper and lower cams and the dome 68 to move between an upright position shown in FIGS. 21-24, and a fully tilted position shown in FIGS. 25-28, as explained below.

The linkage 74 includes as a first link, the follower support 112. The cam follower 110 depends from a bottom surface 114, FIG. 10, near one end 116 of the follower support 112. Slightly rearward of the one end 116, as seen in FIG. 8, is a small hinge base 118 structured to receive a first pin 120 to create a pivot axis. Located rearward of the hinge base 118 of the follower support 112 is a slot 122. A second link 130 of the linkage 74 may take the form of a post 132 with a lower opening 134 and an upper slot 136 as seen in FIG. 8. The lower opening 134 receives the pin 120 that also extends through the hinge base 118 of the follower support 112 to form a pivot joint 138, FIG. 9. The post slot 136 receives a second pin 140 that is slidable in the post slot 136 to allow the post to pivot about the pivot joint 138 between a generally upright position and a slanted position, the post slanted position being illustrated in FIG. 9.

Figure 21:
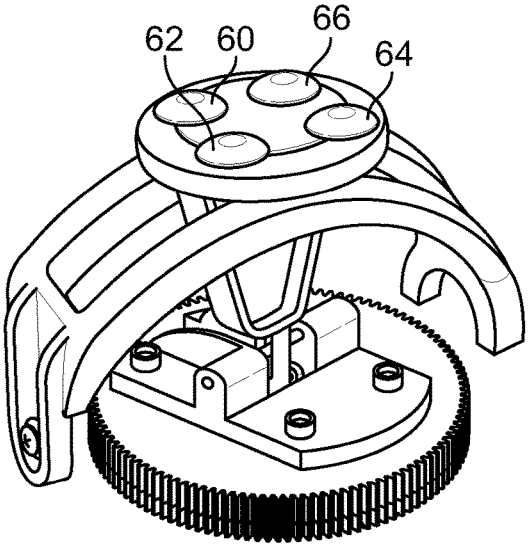
FIG. 21 is an isometric view of a portion of the traverse and elevation mechanism at the beginning of a revolution with the internal magnetic element at a radial limit about the center of the rotatable cams.
Figure 22:
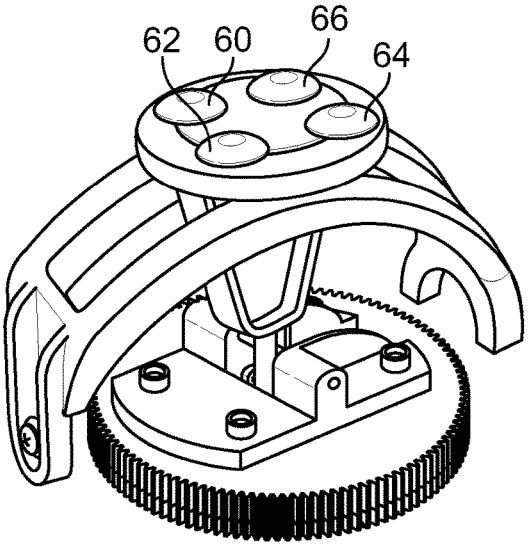
FIG. 22 is an isometric view of the portion of the traverse and elevation mechanism shown in FIG. 21, after a quarter turn from the position shown in FIG. 21.
Figure 23:
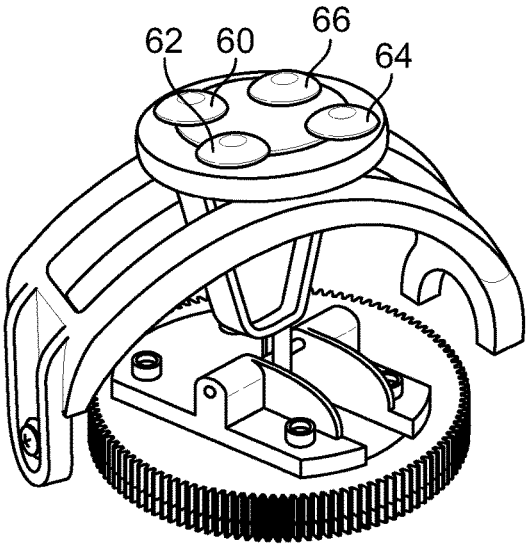
FIG. 23 is an isometric view of the portion of the traverse and elevation mechanism shown in FIGS. 21 and 22, after about a half revolution from the position shown in FIG. 21.
Figure 24:
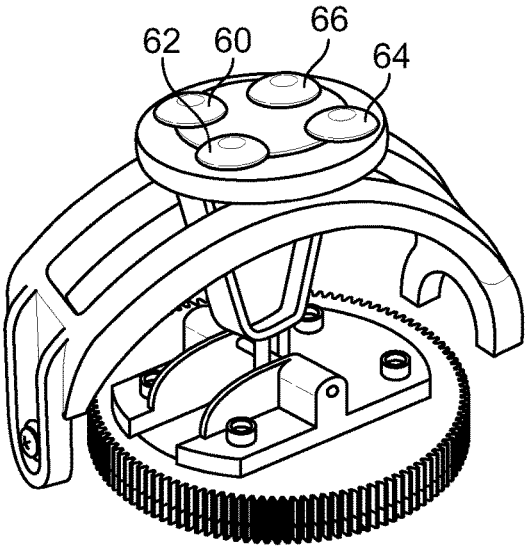
FIG. 24 is an isometric view of the portion of the traverse and elevation mechanism shown in FIGS. 21-23, after about a three-quarters turn from the position shown in FIG. 21.
Figure 26:
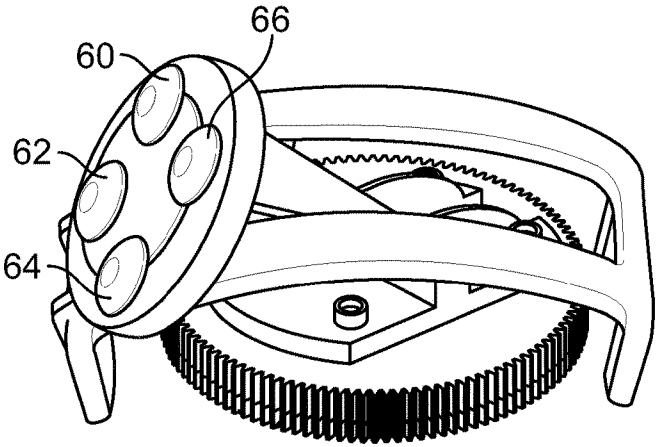
FIG. 26 is an isometric view of the portion of the traverse and elevation mechanism shown in FIG. 25, after about a one-quarter turn from the position shown in FIG. 25.
Figure 28:
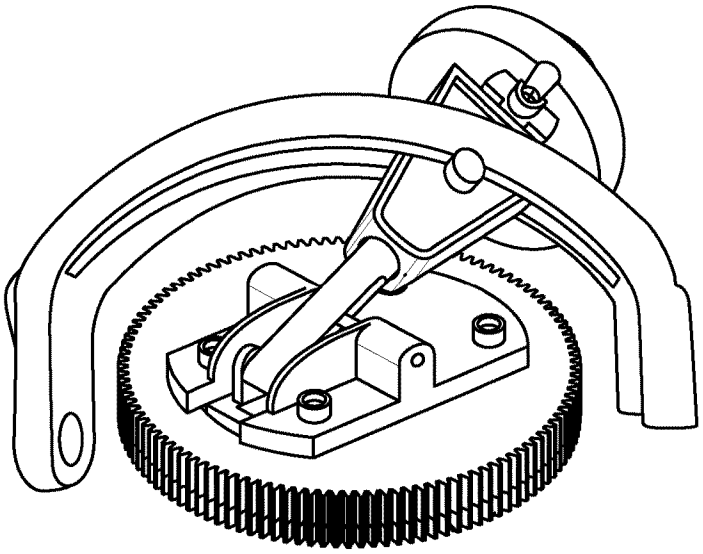
FIG. 28 is an isometric view of the portion of the traverse and elevation mechanism shown in FIGS. 25-27, after a three-quarters turn from the position shown in FIG. 25.
Figure 25:
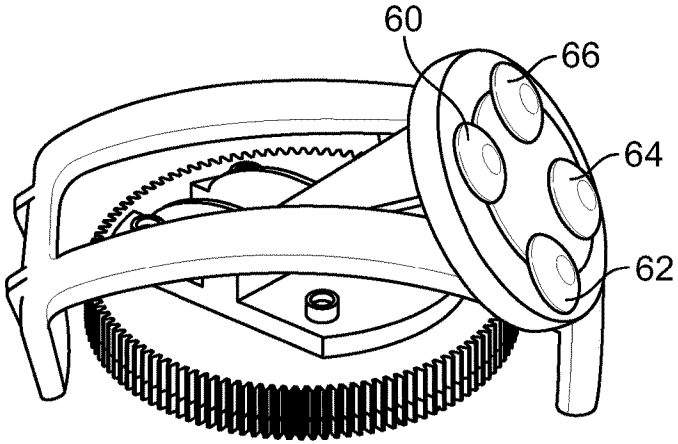
FIG. 25 is an isometric view of the portion of the traverse and elevation mechanism at the beginning of a revolution with the internal magnetic element at an opposite radial limit near the peripheries of the rotatable cams.
Figure 27:
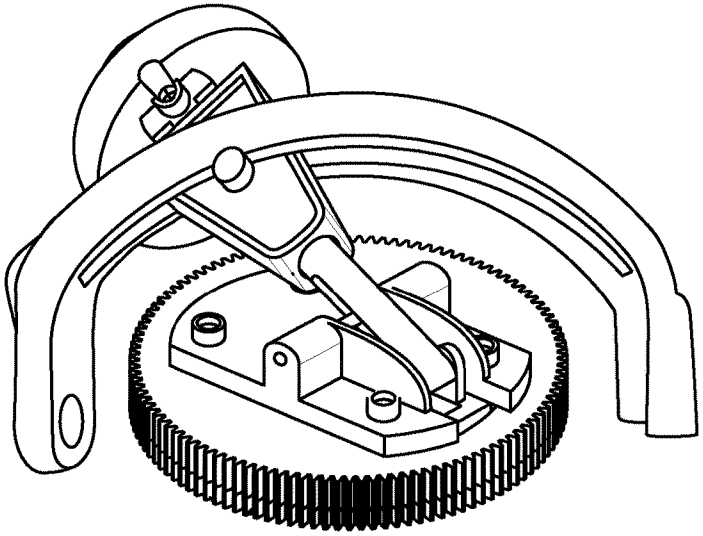
FIG. 27 is an isometric view of the portion of the traverse and elevation mechanism shown in FIGS. 25 and 26, after half a revolution from the position shown in FIG. 25.

A third link 150 of the linkage 74 may include a large hinge base 152 and curved flanges 154, 156. The large hinge base 152 receives the second pin 140 that allows the post 132 to pivot about the pivot joint 138. When the pivot joint 138 created by the pin 120 is located near the periphery of the cams 80, 82, the position shown in FIG. 9, the post 132 is slanted and the internal magnetic elements will also be slanted, as shown in FIG. 25. When the post 132 is moved to a position closer to the large hinge base 152, the post 132 will move to a more upright position in relation to the third link 150 and the internal magnetic elements will appear as shown in FIG. 21. Four screw openings 160, 162, 164, 166 are provided to allow attachment of the linkage 74 to a mounting bracket on the top surface of the cam 82.

In the alternative, the linkage may take any suitable form, such as those shown, for example, in the additional embodiments described below.

Figure 11:
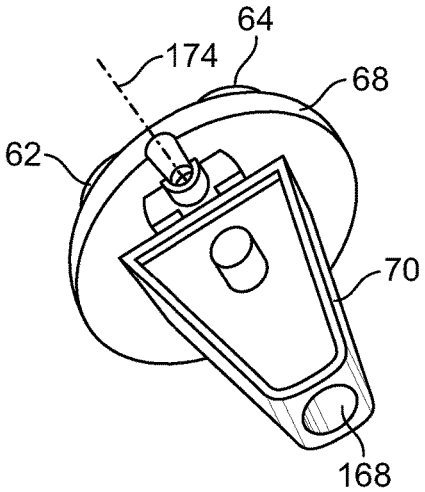
FIG. 11 is an upward looking isometric view of an internal magnetic element carrying dome of the traverse and elevation mechanism.
Figure 12:
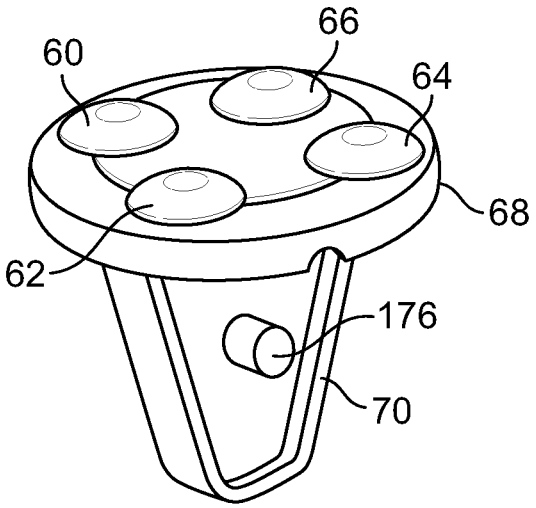
FIG. 12 is a downward looking isometric view of the dome shown in FIG. 11.
Figure 13:
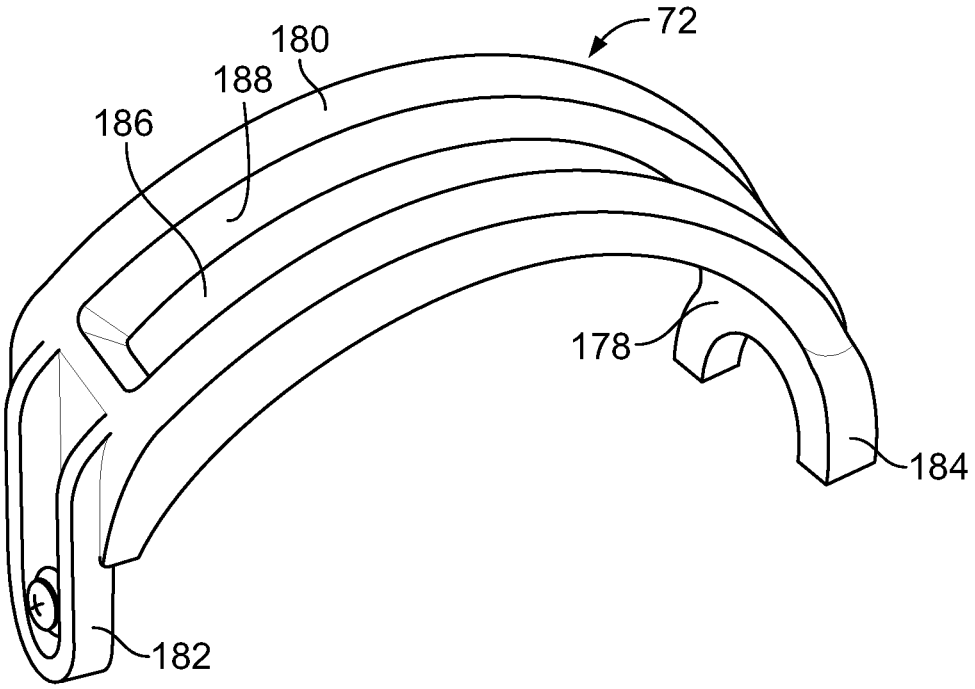
FIG. 13 is an isometric view of an arcuate track of the traverse and elevation mechanism.

Referring now to FIGS. 11 and 12, the base 70 of the dome 68 includes a bottom opening 168 for receiving an upper end portion 170, FIG. 8, of the post 132 to allow the distance from the first pin 120 to the dome 68 to vary as a function of the radial location of the linkage 74. The dome 68 may be pivotally mounted to the base 70 about an axis 174. As the dome with the magnetic elements moves between a vertical position and a slanted position, the arcuate track 72, FIG. 13, supports and helps guide the base 70 and the dome 68. A guide shaft 176, FIG. 12, in the base 70 is movable along the underside 178, FIG. 13, of the arcuate track 72 while the dome rides on an upper side 180 of the arcuate track. The arcuate track 72 is pivotally mounted to the receptacle 36 through arms 182, 184 and includes an arcuate slot 186 with a border wall 188. The base 70 rides in the slot 186 as the lower and upper rotatable cams 80, 82, move the internal magnetic elements.

Figure 14:
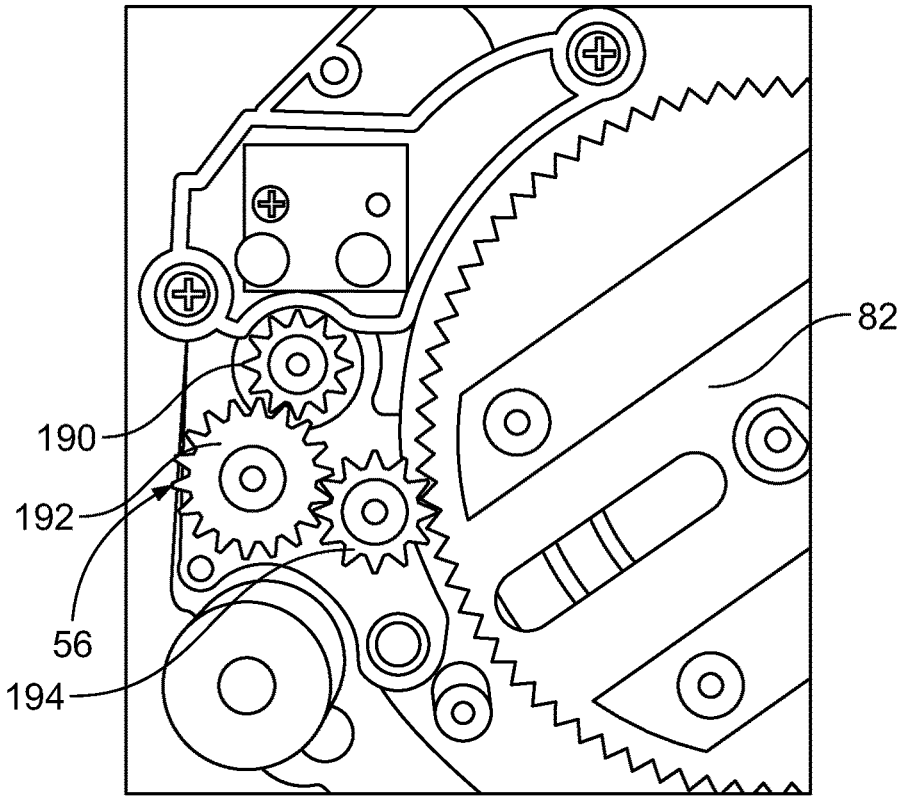
FIG. 14 is a top plan view of an engaged transmission of the traverse and elevation mechanism.
Figure 15:
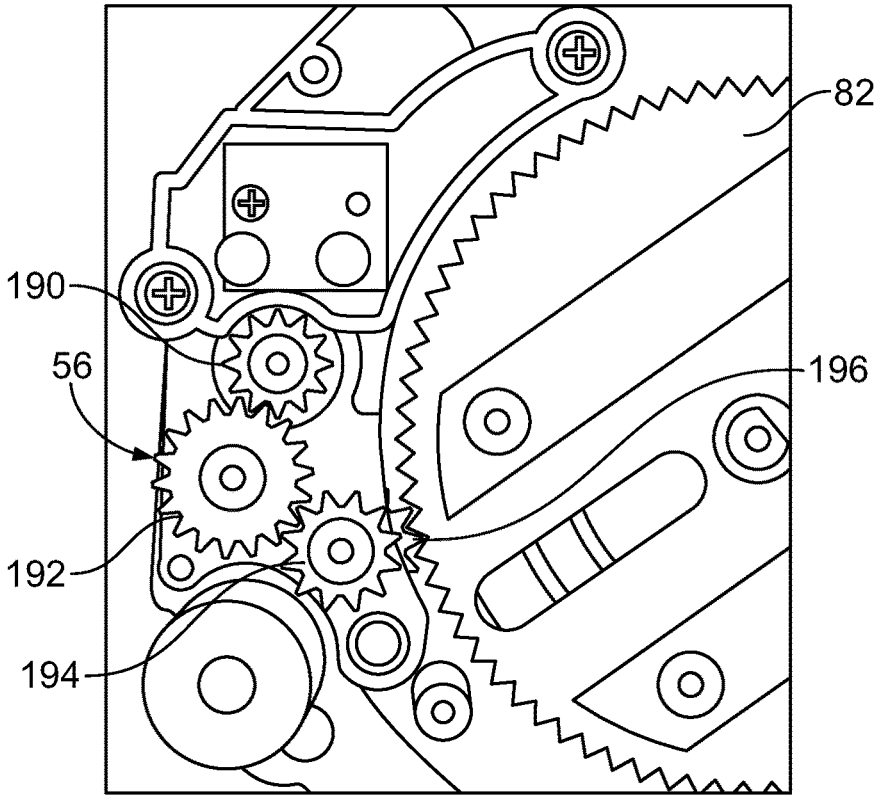
FIG. 15 is a top plan view of the transmission shown in FIG. 14, but in a partially disengaged mode.

As mentioned, the transmission 56 connects the reversible motor 52 to the lower and upper cams 80, 82. The transmission 56 may be a set of gears as shown in FIGS. 14 and 15. The reversible motor 52, FIG. 2, rotates a first pair of stacked gears, a top gear 190 and another identical gear (not shown) beneath the gear 190. The first pair of gears meshes with a second pair of stacked gears of which the gear 192 is uppermost. The second pair of stacked gears meshes with a third pair of almost stacked gears of which the gear 194 is uppermost. Beneath the gear 194 is another gear 196. As depicted in FIG. 14, the gear 194 respectively engages the upper cam 82 and the lower gear 196 engages the lower cam 80. When the reversible motor 52 moves in a first direction the gears 194 and 196 engage both of the cams 80, 82 as shown in FIG. 14. When the reversible motor 52 moves in a second opposite direction, the gear 194 can be disengaged from the upper cam 82 as shown in FIG. 15, so that only the lower gear 196 rotates the lower cam 80.

Whether the reversible motor and cams engage is a function of the direction of rotation of the reversible motor 52, the only motor that operates the traverse and elevation mechanism. When the reversible motor 52 operates in a first direction, only the lower cam 80 rotates and moves the cam follower 110. When the reversible motor 52 operates in a second opposite direction, both of the lower and upper cams 80, 82 rotate simultaneously. To ensure that the upper cam 82 does not move when the reversible motor 52 in the first direction, a ratchet 200, FIG. 4, connected to the receptacle 36, engages the upper cam 82 to prevent rotation.

In the alternative, the toy robot may take a different form such as a rolling cylinder, a cylinder with legs and a spinning top, like the STAR WARS R2D2® robot or a more human looking robot like the STAR WARS C-3PO®. An alternative to the gear set may be a belt driven system whereas an alternative to the linkage may be a gear set or a belt driven system. The cams may have different peripheral shapes or operate with side surface protrusions. Elements may be placed on the underside of the appendage 14 (not shown) to facilitate movement, such as a TEFLON® coating, wheels, casters, skids or ball bearings, to name just a few examples. In the case of the BB-8 robot, the appendage 14 may function as a head for the robot.

Referring now to FIG. 16, an exploded view of the toy robot 10 minus the appendage 14 is illustrated, with focus on the traverse and elevation mechanism. At the top of the figure is an upper half 12*a* of the spherical housing 12 and at the bottom of the figure is a lower half 12*b* of the spherical housing. Beneath the housing upper half 12*a* is the internal magnetic elements mounted on the dome 68, followed by the arcuate track 72, the post 132 of the second link, the third link 150 and, next, the first link 112. Beneath the links of the linkage is a top cover 36*a* of the receptacle 36. Within the top cover 36*a* are the upper cam 82 and the lower cam 80. Under the cams is the base 36*b* of the receptacle 36 showing the receptacle shaft 90 on which the cams are mounted.

The two basic movements of the traverse and elevation mechanism 50 are depicted in diagrammatic form in FIGS. 17-20. Assuming a start at a radial center position 210, FIG. 17, of the mechanism, when the reversible motor 52 rotates in the first direction only the lower cam 80 rotates and the cam follower changes its location away from the radial center position to a new more peripheral position 212, FIG. 18.

Figure 19:
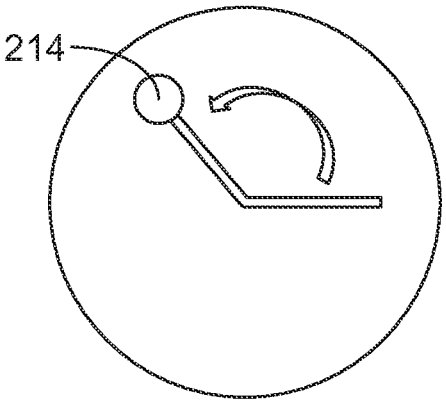
FIG. 19 is a diagrammatic plan view of the internal magnetic element illustrating a partial sweep.
Figure 20:
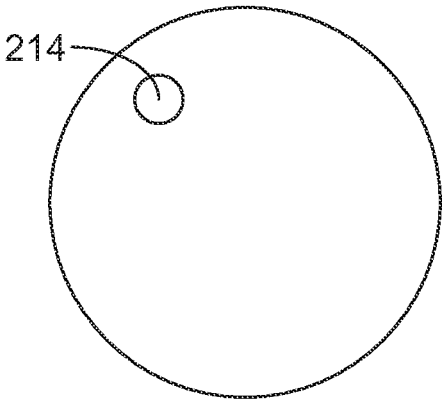
FIG. 20 is a diagrammatic plan view of the internal magnetic element at a position after radial and angular changes.

When the reversible motor 52 is rotated in the second direction, both cams rotate and sweep the internal magnetic elements 214 as shown in FIG. 19. When rotations of the two cams stop the position of the internal magnetic elements are shown in FIG. 20. Using polar coordinates, as will be explained in more detail below, the position 210 of the internal magnetic elements will likely be approximately 90° relative to the rotatable cams, and the position 214 will likely tilt the internal magnetic elements at approximately 45° relative to the rotatable cams. It is to be understood that changing the dimensions or shapes of the various parts identified above may alter the coordinates.

It is important to note that only a single motor controls the mechanism 50 to move the internal magnetic elements. One cam controls the radial position of the internal magnetic elements and both cams control the sweep or region coverable by the internal magnetic elements. In order to control these cams, the single motor spins in the first direction to control one cam and the radial variable, and when the single motor spins in the second direction, the sweep occurs. Thus, the mechanism is compact, lightweight, simply constructed, inexpensive and yet, robust and efficient.

Figure 29:
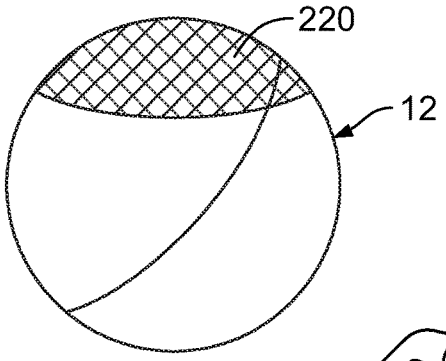
FIG. 29 is a view of the spherical housing with a region representing the movement limits of the traverse and elevation mechanism drawn in a crosshatch pattern.

The limits of actual movement of the illustrated traverse and elevation mechanism are shown in FIGS. 21-28. At one limit, where the operator has selected a radius of zero, the center of the cams, rotation of the lower and upper cams 80, 82 shows essentially no movement of the internal magnetic elements 60, 62, 64, 66 when viewed approximately every quarter turn, as shown in FIGS. 21-24. The internal magnetic elements are positioned approximately perpendicular relative to the rotational planes of the lower and upper cams. At the opposite limit, where the operator has selected a radial position of the cam followers near the peripheries of the cams, the internal magnetic elements assume an angular position at about 45° from the rotational planes of the cams as shown in FIGS. 25-28. The angular position shown in FIG. 25, may be considered the "full tilt" position, whatever the actual angle. The traverse and elevation mechanism is capable of sweeping a portion of the inner surface of the spherical housing as illustrated in a crosshatch pattern 220, FIG. 29. It is noted that the orientation of the spherical housing 12 is of no concern because the crosshatch region remains the same relative to the spherical housing even if the spherical housing is rolling along a surface at the same time as the traverse and elevation reversible motor is activated.

It is to be understood that in operation, the operator may move the internal magnetic elements around the region 220 defined generally in polar coordinates between (0, 90°), the position shown in FIG. 21, and (r≈45°), the position shown in FIG. 25, where "0" is the position of the post 132, "r" is the position of the pivot joint 138, and the parallel wavy lines symbol (≈) means "approximation."

In the alternative, the internal magnetic element may be replaced with other structures that require radial and angular adjustment, such as a gun or machine tool, for example.

Figure 30:
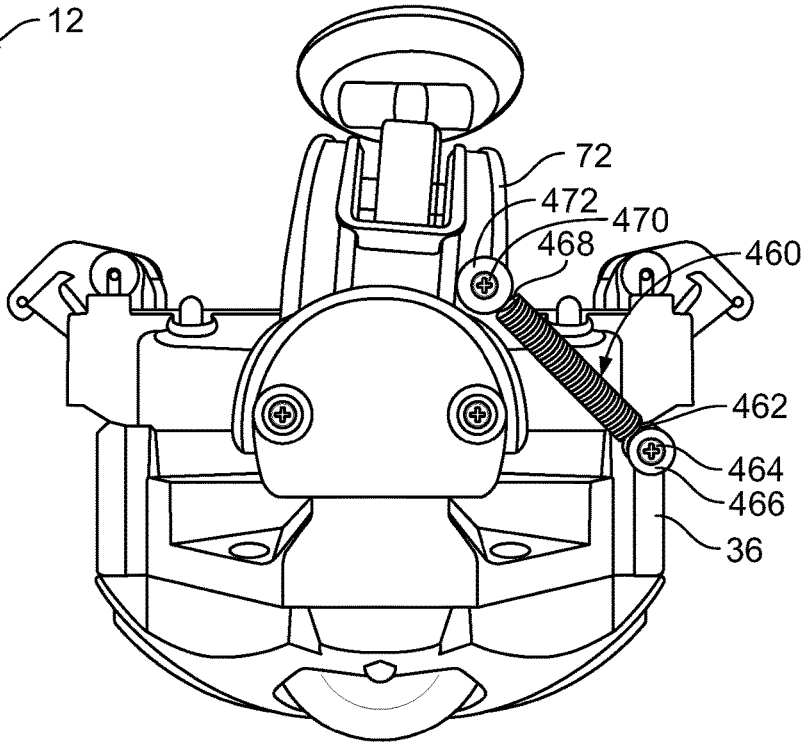
FIG. 30 is an isometric side view of the traverse and elevation mechanism and the drive apparatus as shown in FIG. 3, but rotated 180° and illustrating an extension spring.
Figure 31:
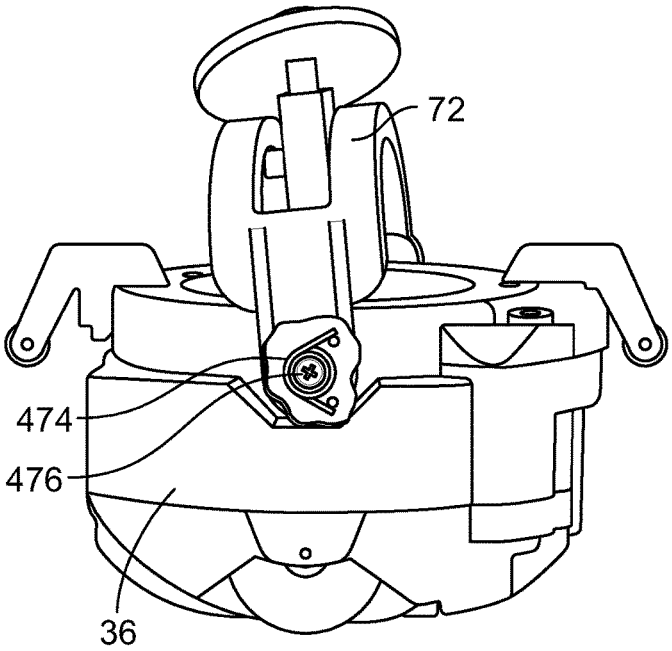
FIG. 31 is an isometric side view of the traverse and elevation mechanism and the drive apparatus as shown in FIG. 3, but with a break-away view of a torsion spring.

It has been found that when the toy robot 10 comes to rest after movement the head 14 on the spherical housing 12 tended to droop forward. Apparently, loose tolerances of various components of the robot cause the drooping condition. It has been found that a resilient element, such as an extension spring 460, FIG. 30, acting on the arcuate track 72, provides sufficient restraint on the head to prevent the unwanted drooping. One end 462 of the spring 460 is connected to the receptacle 36 with a screw 464 and a washer 466 and the other end 468 of the spring 460 is extended to connect to the arcuate track 72 with another screw 470 and washer 472. The spring may be made with wire having an outer diameter of 0.5 mm, a coil outer diameter of 5.6 mm, a coil inner diameter of 4.45 mm, a length of 23.5 mm and a spring rate of 2.36 kg/mm. Other spring rates within the range of 1.89 to 2.68 kg/mm have proven acceptable. In the alternative, a torsion spring 474, FIG. 31, may be used mounted around a screw 476 located at the axis of rotation of the arcuate track 72. Other resilient elements, such as a resilient band, for example, may also work to control the head.

Figure 32:
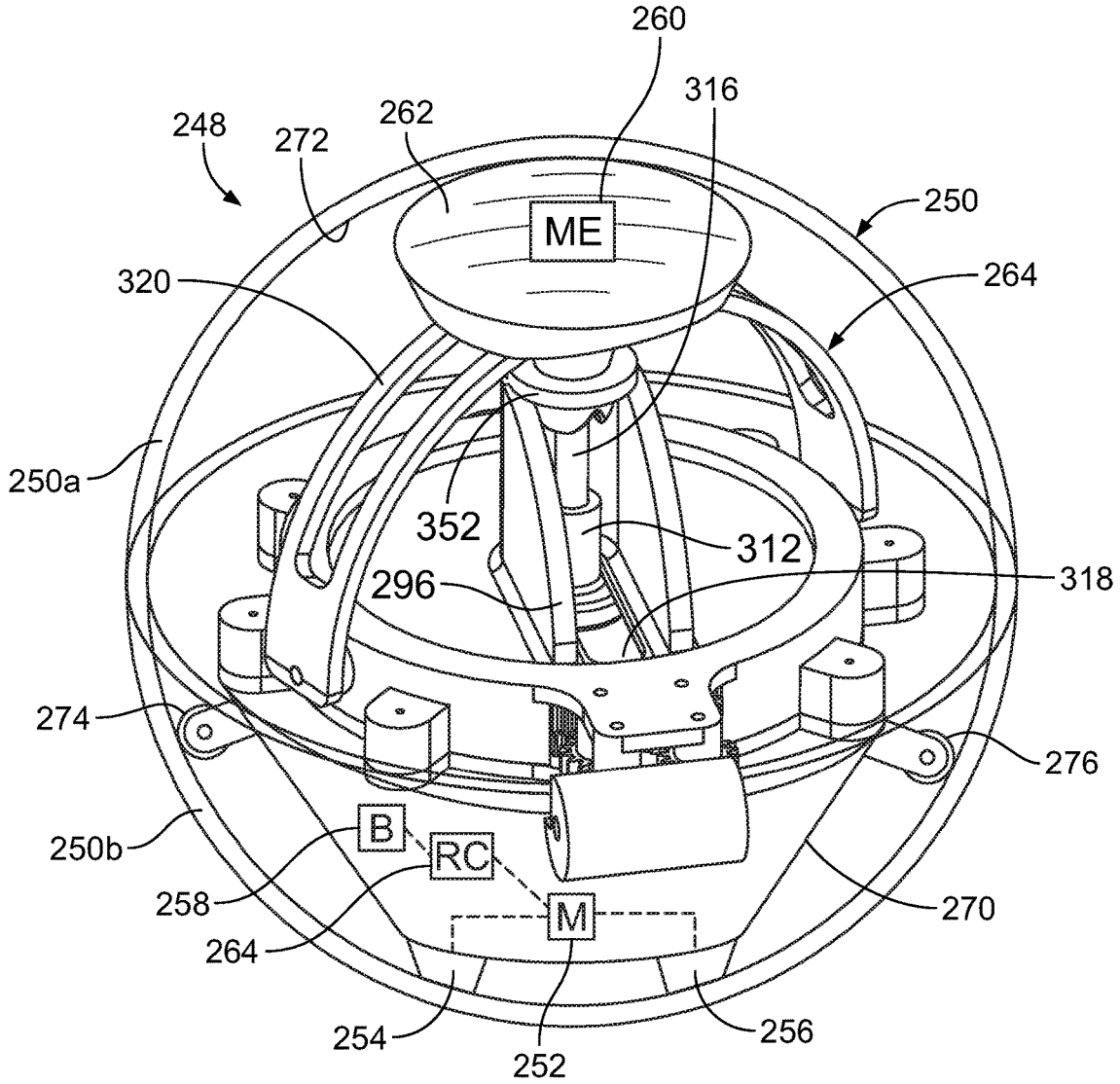
FIG. 32 is an isometric view of another embodiment of the traverse and elevation mechanism of the present invention within a spherical housing and mounted to a receptacle.
Figure 33:
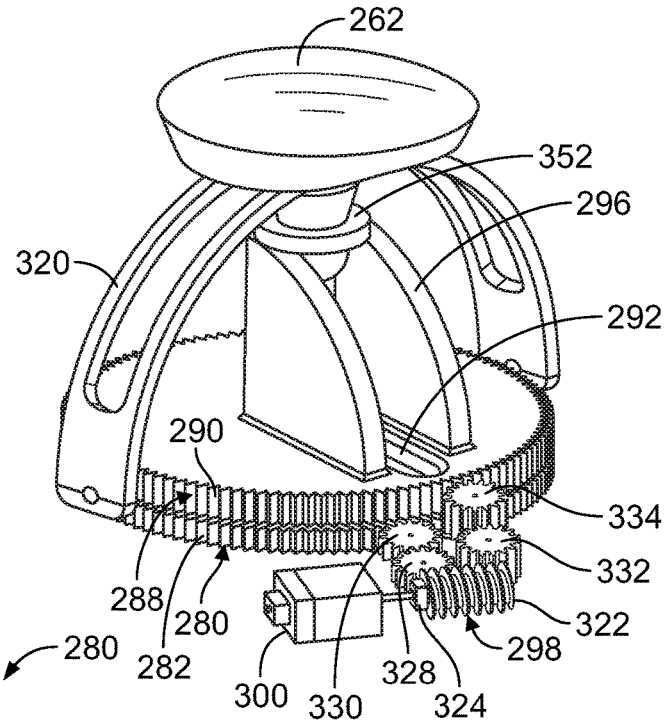
FIG. 33 is an isometric view of the traverse and elevation mechanism without the spherical housing and the receptacle.

Referring now to FIGS. 32-33, there is illustrated another toy robot embodiment 248 of the present invention. The robot 248 is structured and operated in a similar way to the toy robot illustrated in FIGS. 1-31. The traverse and elevation mechanism is located in a spherical housing 250 and is remote controlled. The robot 248 may be designed to look and act just like the lower portion of the toy robot illustrated in FIG. 1.

One or more magnetic element, such as the magnetic element 260, may be mounted to a dome 262 in the spherical housing 250, where the dome 262 is part of a traverse and elevation mechanism, which may be termed more broadly as a movement mechanism 264. The movement mechanism 264 is also packaged in the spherical housing. The movement mechanism may be controlled by manipulating control switches on a remote control housing, just like the switches 28, 30 on the remote control housing 16 described for the earlier embodiment. The magnetic element 260 engages another magnetic element in an appendage (like the appendage 14, but not shown in FIG. 32). An operator is able to move the appendage around the upper portion of the spherical housing by moving the magnetic element 260 within the spherical housing. At the same time, the operator may be remotely causing the toy robot to roll along a surface, or the operator may maintain the robot in a stationary position while moving the appendage about the spherical housing 250, again just like that described in the earlier embodiment.

Two drive motors represent by the box 252 may drive wheels 254, 256 where the motors may receive power from batteries in a battery compartment 258. The wheels, the motors and the batteries as well as an RC receiver 264 may be packaged in a receptacle 270 as shown, the battery compartment, the motors and the RC receiver being depicted diagrammatically. The wheels bear against an interior surface 272 of the spherical housing. Two or more support arms, such as the arms 274, 276 may be provided to help maintain the receptacle 270 in an upright position within the spherical housing 250.

The spherical housing 250 may be divided in two halves, a first half 250*a* and a second half 250*b*. The movement mechanism 264 is mounted to the receptacle 270 to allow the internal magnetic element 260 to move about the interior surface 272 of the spherical housing while the internal magnetic element maintains a magnetic attraction with the external magnetic element located in the appendage. Movements of the internal magnetic element will result in similar movements of the external magnetic element.

Figure 34:
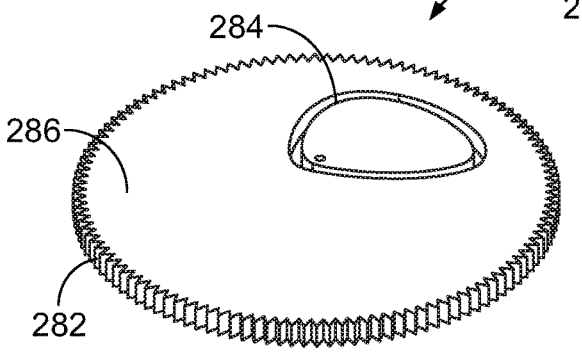
FIG. 34 is an isometric view of a lower rotatable cam with a raceway in a side surface.
Figure 35:
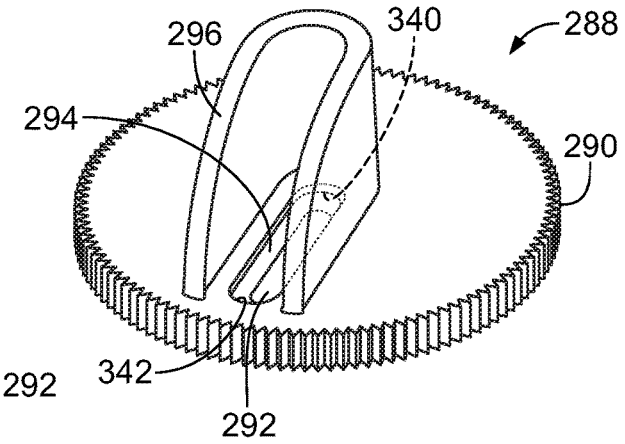
FIG. 35 is a downward looking isometric view of an upper rotatable cam with a slot and an integral guide slide.
Figure 36:
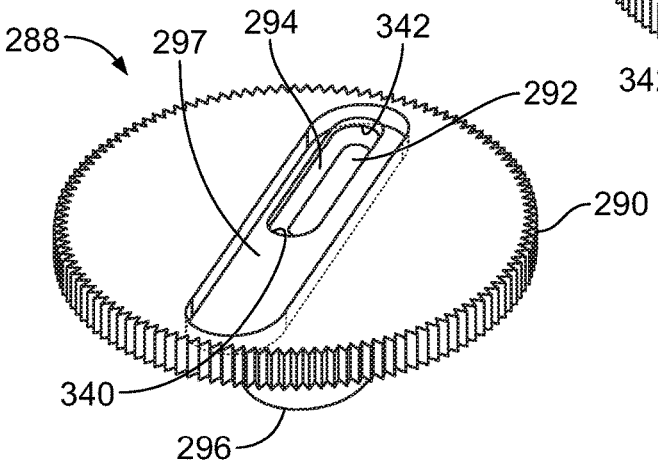
FIG. 36 is an upward looking isometric view of the upper rotatable cam.

The movement mechanism includes a first or lower rotatable cam 280, FIGS. 33 and 34, that may take the form of a circular gear with a periphery of gear teeth 282 and a raceway or groove 284 in a generally planar side surface 286 and is mounted to a rotatable receptacle shaft (not shown). A second or upper rotatable cam 288, FIGS. 33, 35 and 36, is also included and is mounted concentric with the lower cam 280 as shown in FIG. 33. The upper cam 288, may also take the form of a circular gear with a periphery of gear teeth 290. The upper cam 288 includes a radially disposed slot 292 with a bordering wall 294. The upper cam 288 also may support a guide slide 296 on an upper side and a channel 297 on a lower side.

Figure 44:
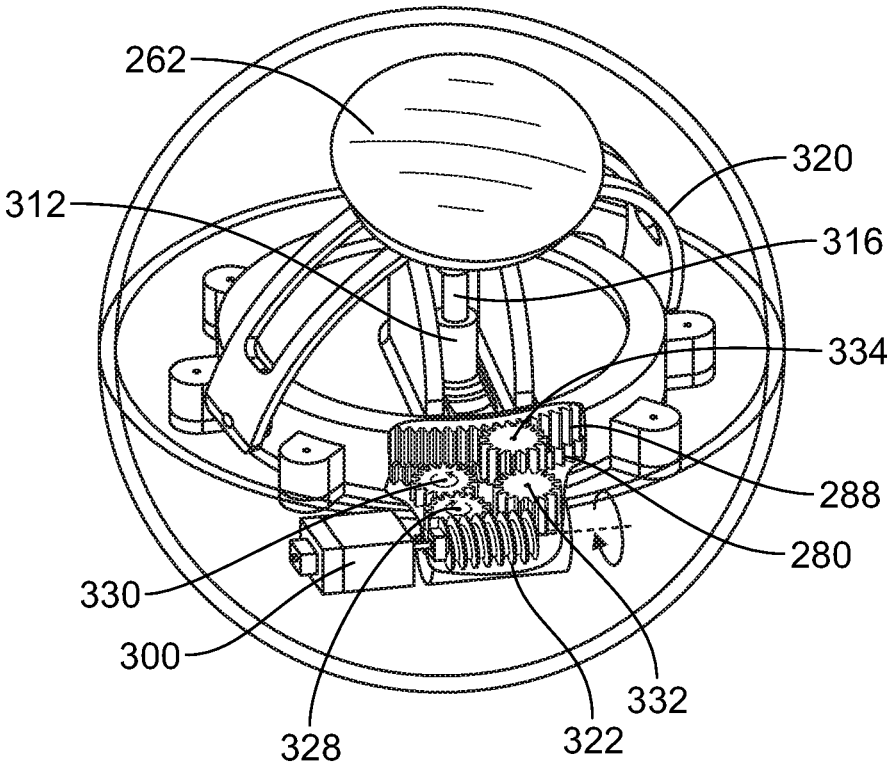
FIG. 44 is an isometric view of the internal magnetic element at one radial limit at about the center of the rotatable cams.

The movement mechanism 264 may include a transmission 298, FIG. 33, such as a gear train, operated by a single reversible motor 300 which is able to receive communication from the RC equipment mounted in the control housing and in the spherical housing. The motor 300 is reversible, capable of operating in both a first direction as well as an opposite second direction, as will be illustrated below in reference to FIGS. 44 and 45. The motor 300 operates the movement mechanism 264 through the gear train transmission 298, the lower and upper cams 280, 288, and the cam follower to be described below. In the alternative, the transmission may be a belt drive or a combination of a belt drive and a gear train.

Figure 37:
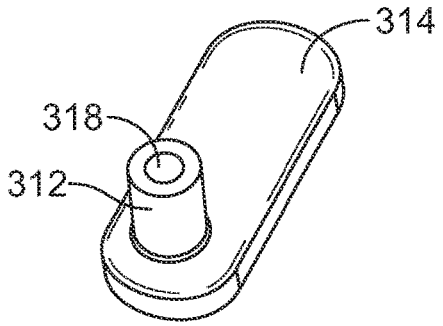
FIG. 37 is an enlarged downward looking isometric view of an integral cam follower, a sleeve and a base.
Figure 38:
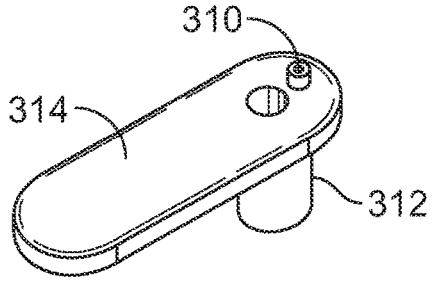
FIG. 38 is an upward looking isometric view of the integral cam follower, the sleeve and the base shown in FIG. 37.
Figure 41:
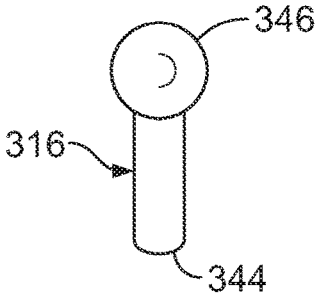
FIG. 41 is an enlarged isometric view of a linkage that helps join the cams and the dome.

Referring now to FIGS. 37 and 38, a cam follower 310 is mounted to the lower cam 280 and is connected to the upper cam 288 so as to be movable by the lower cam 280 and by both of the cams 280, 288. The cam follower 310 may be formed as part of an integral plastic element including a sleeve 312 and a base 314. A linkage 316, FIGS. 32 and 41, is movable within an opening 318, FIG. 37, in the sleeve 312 by telescoping within the opening 318. The linkage 316 connects movement of the cams with the dome carrying magnetic element. The dome 262 is mounted to slide along the guide slide 296, FIGS. 33 and 35, and is also supported by an arcuate track 320, FIGS. 33 and 42. The cam follower base 314 moves in the channel 297, FIG. 36, of the upper cam to position the second cam follower 312 in the slot 292.

Figure 45:
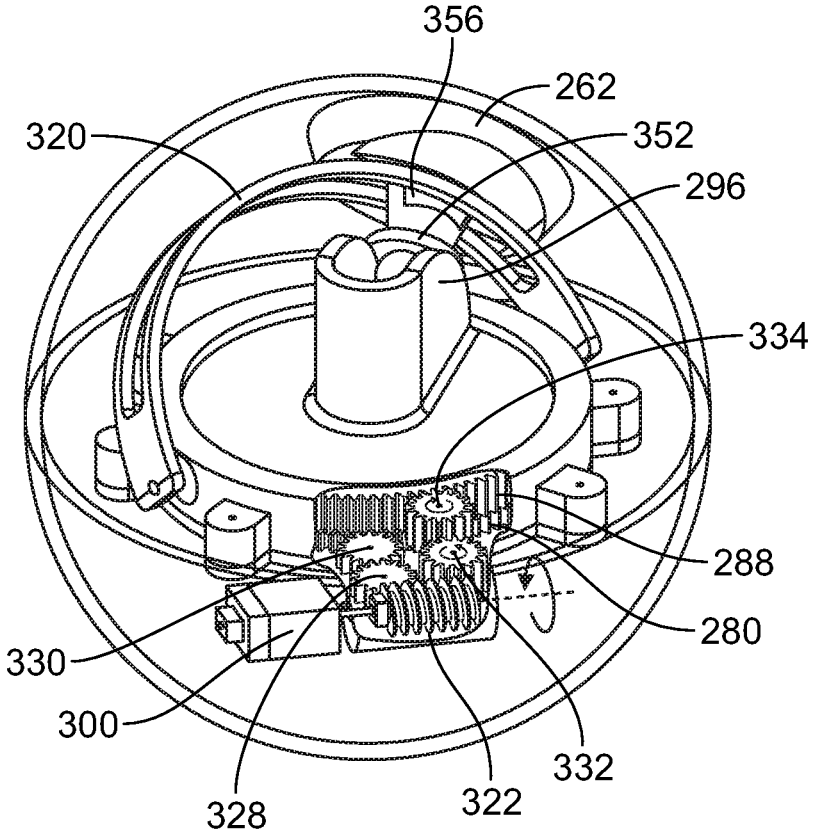
FIG. 45 is an isometric view of the internal magnetic element at an opposite radial limit near the peripheries of the rotatable cams or the dome at "full tilt."
Figure 46:
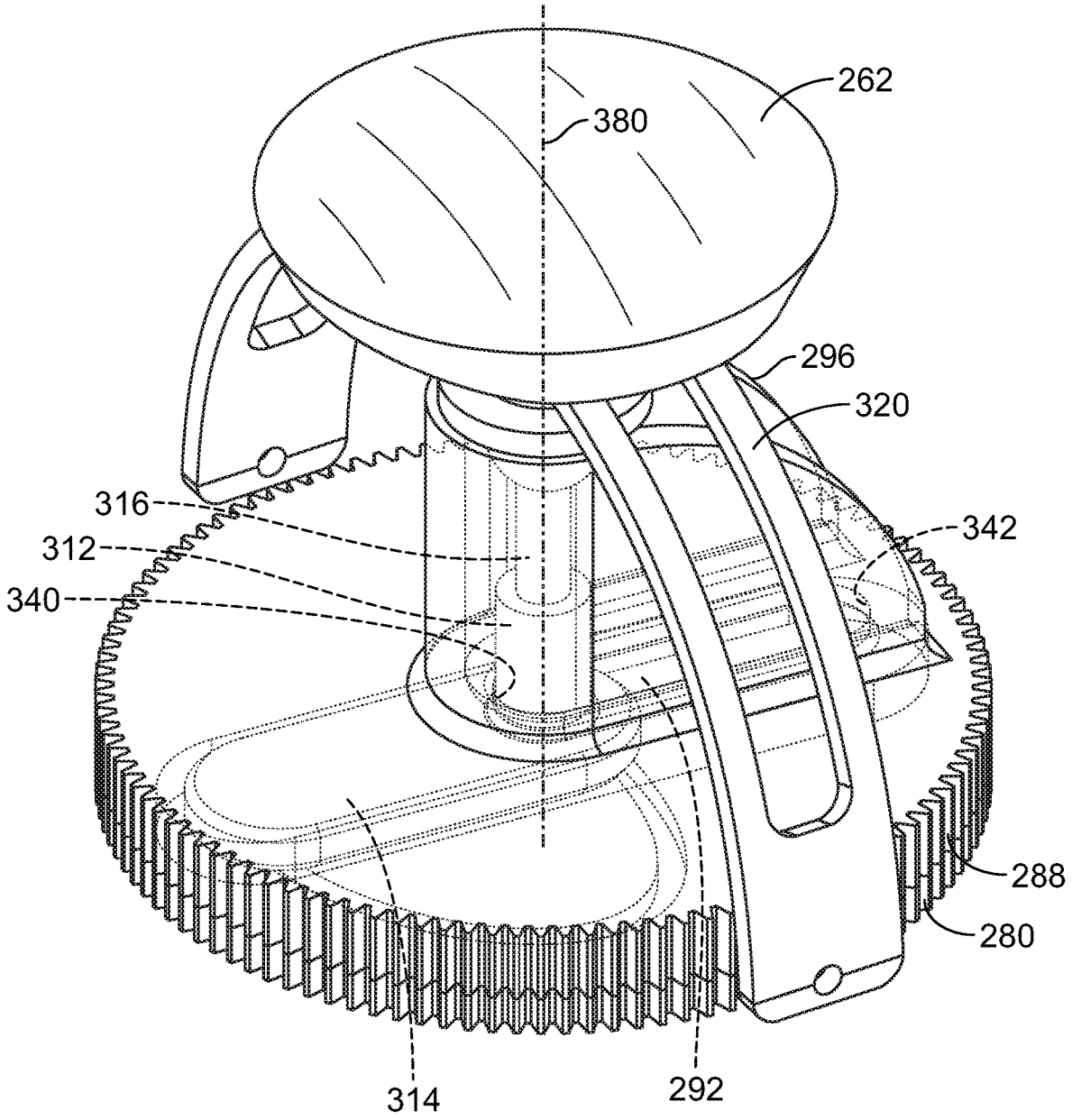
FIG. 46 is an isometric view of a portion of the traverse and elevation mechanism at the beginning of a revolution with the internal magnetic element at the radial limit about the center of the rotatable cams.
Figure 47:
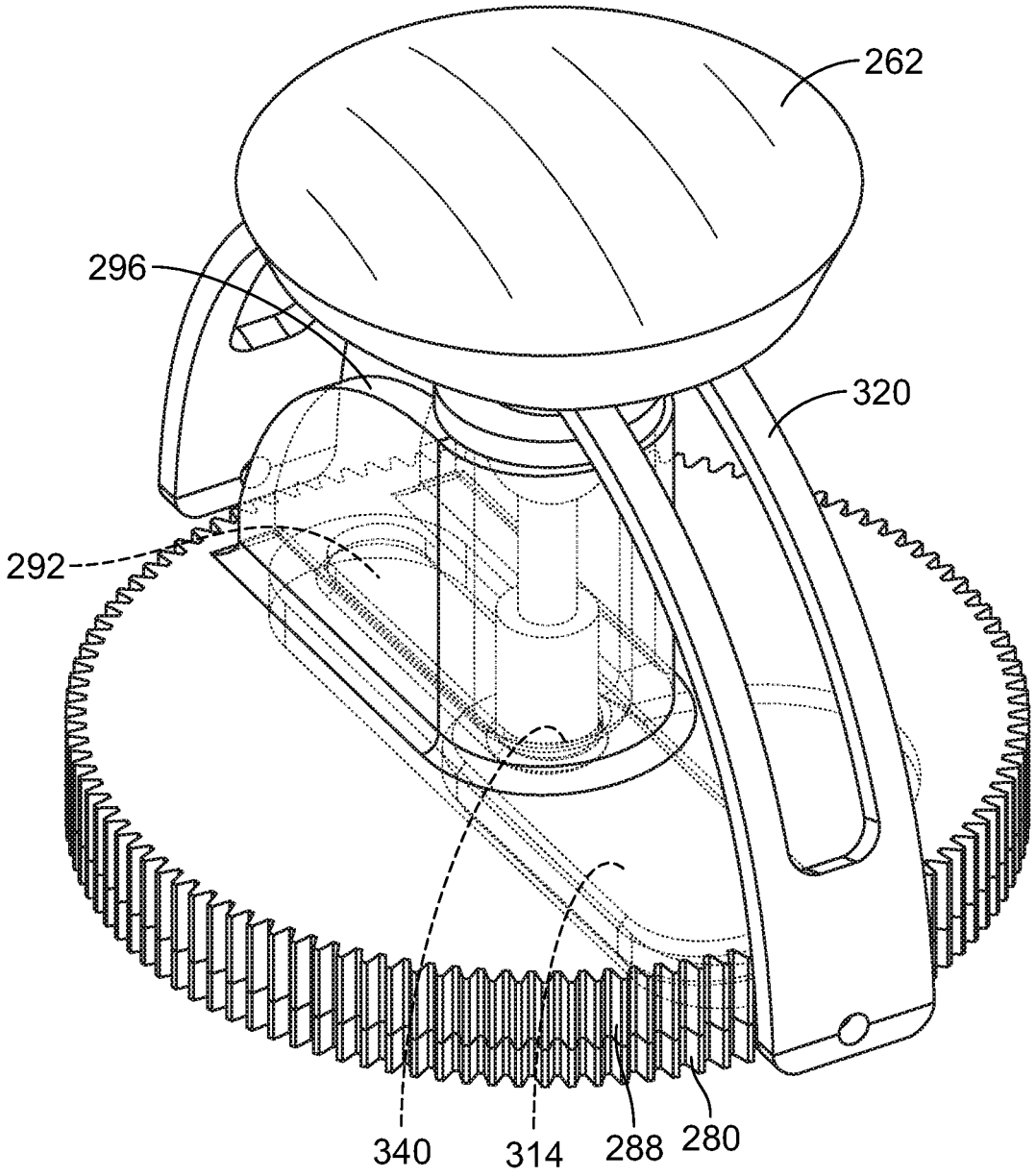
FIG. 47 is an isometric view of the portion of the traverse and elevation mechanism shown in FIG. 46, after a quarter turn from the position shown in FIG. 46.
Figure 48:
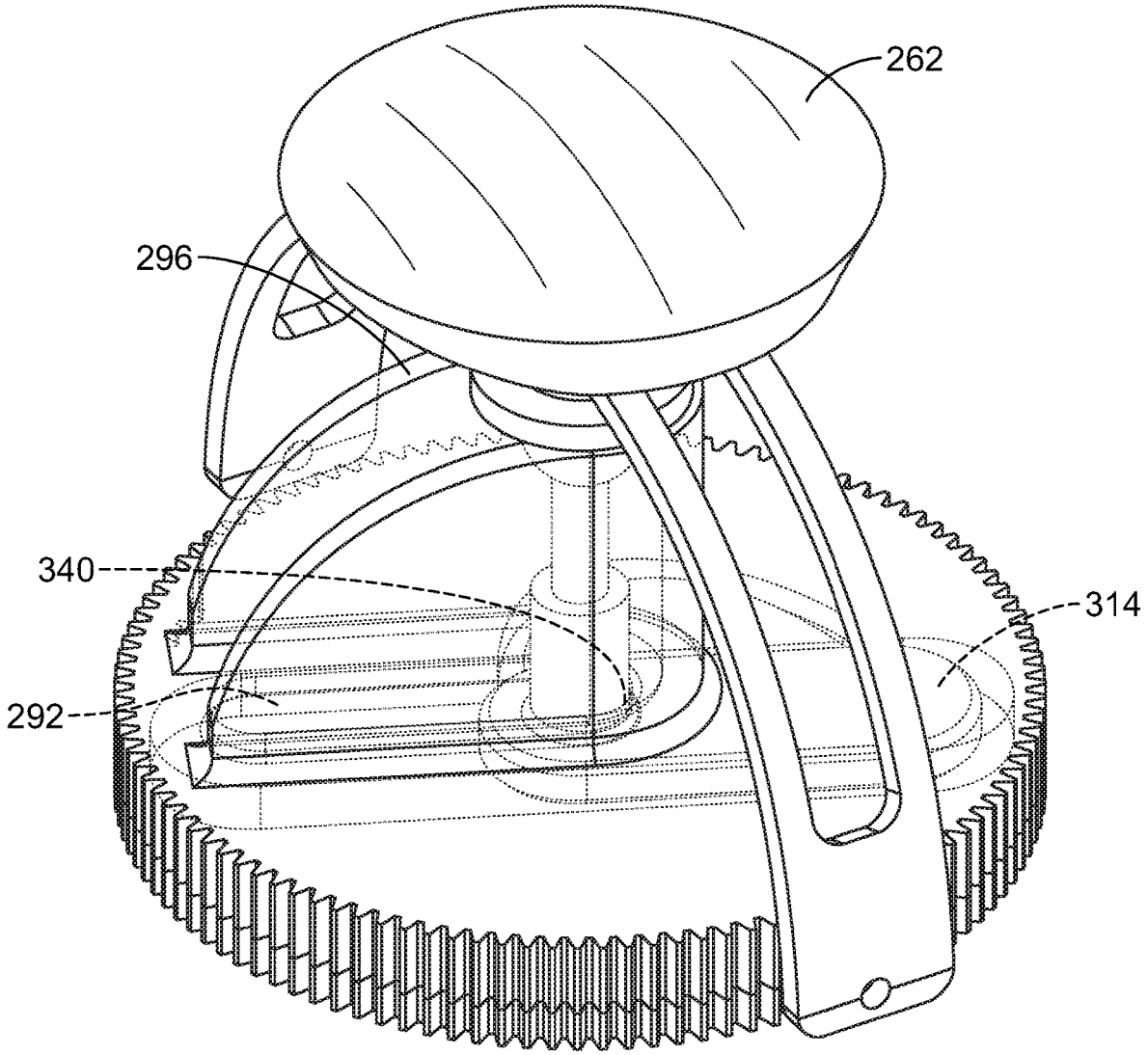
FIG. 48 is an isometric view of the portion of the traverse and elevation mechanism shown in FIGS. 46 and 47, after about half a revolution from the position shown in FIG. 46.
Figure 49:
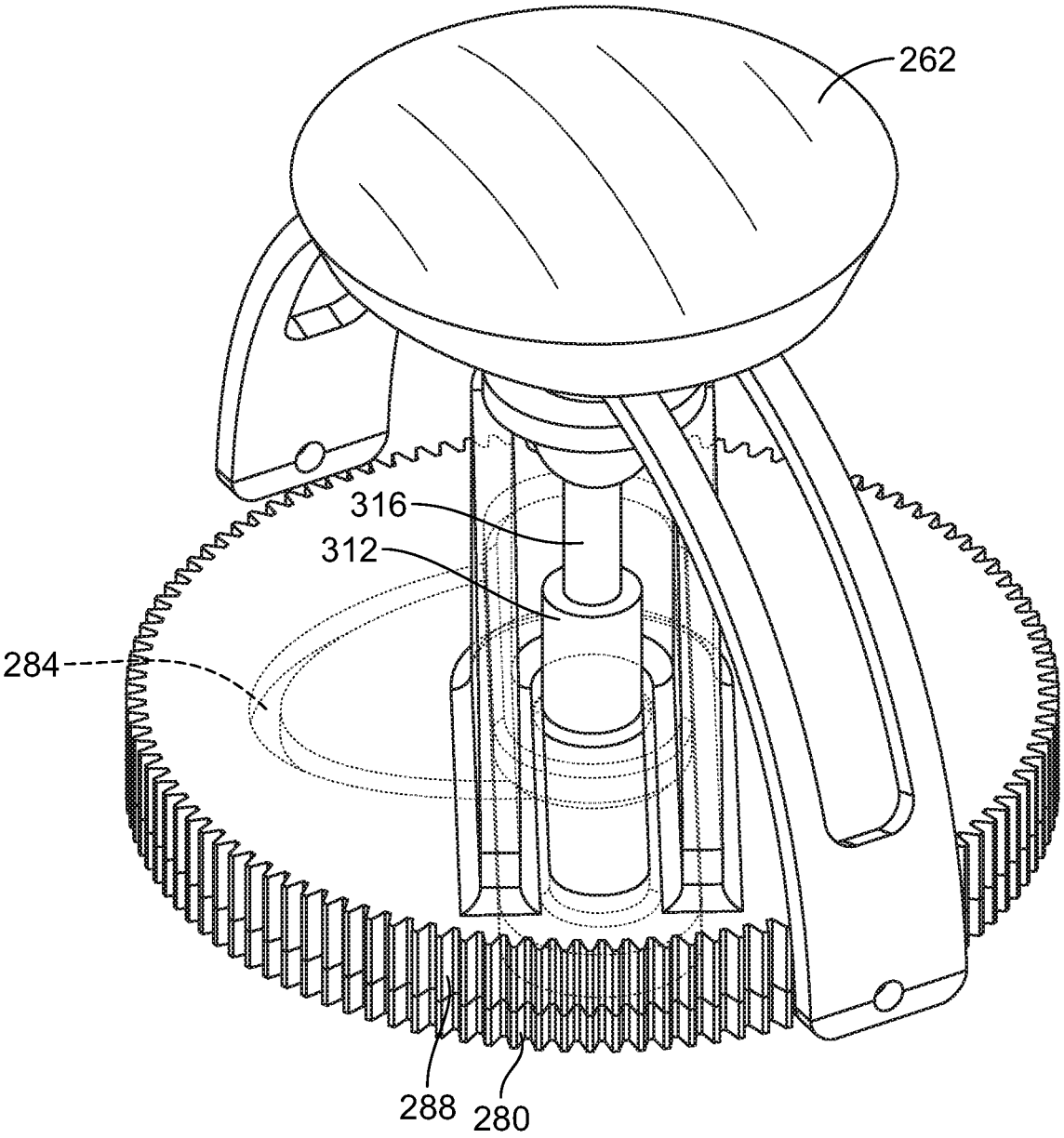
FIG. 49 is an isometric view of the portion of the traverse and elevation mechanism after about a three-quarters turn from the position shown in FIG. 46.
Figure 50:
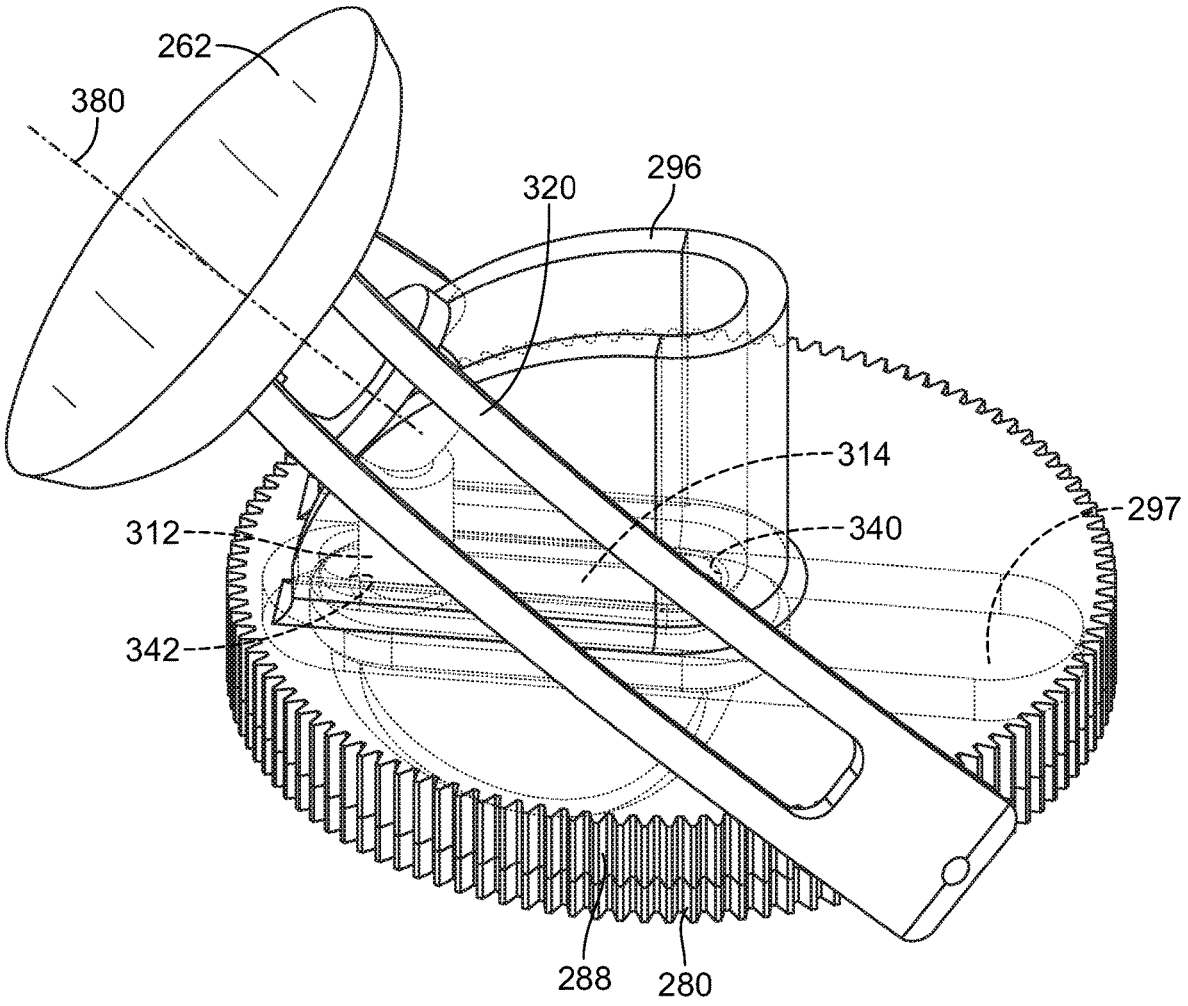
FIG. 50 is an isometric view of the portion of the traverse and elevation mechanism at the beginning of a revolution with the internal magnetic element at the radial limit near the peripheries of the rotatable cams.
Figure 51:
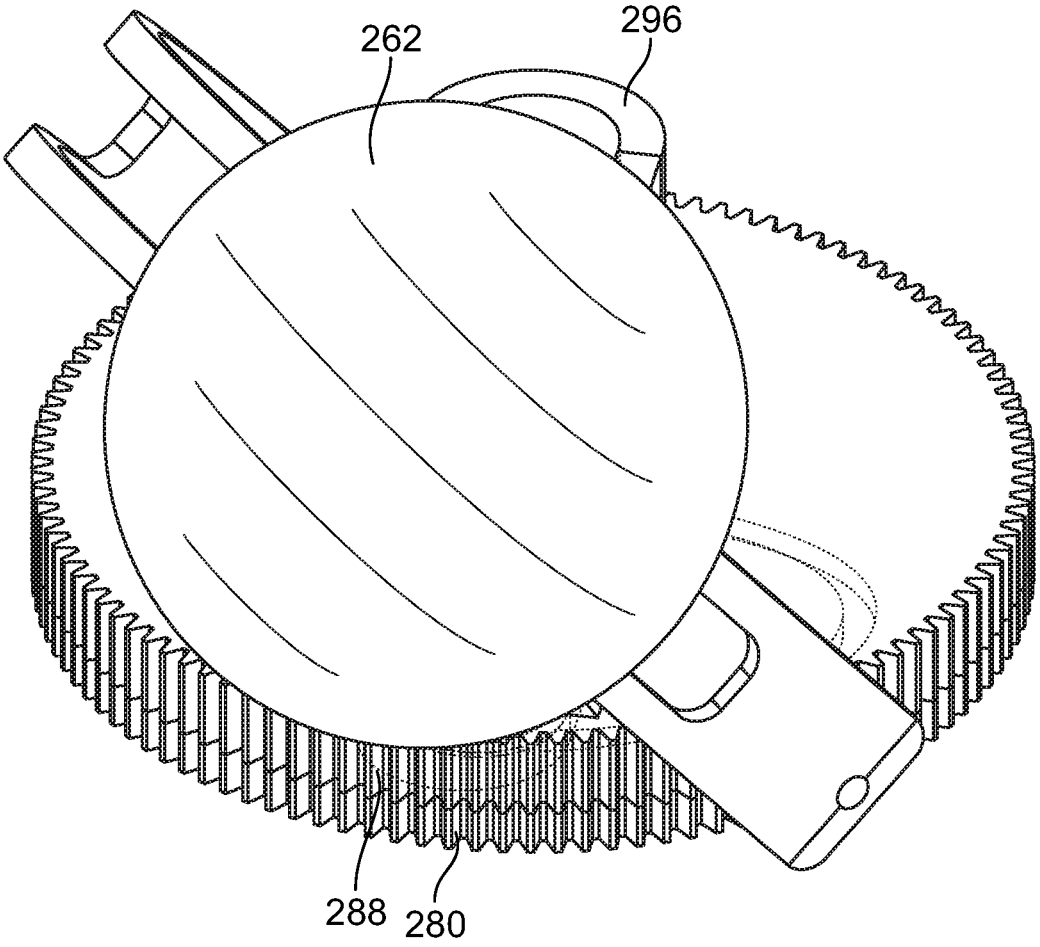
FIG. 51 is an isometric view of the portion of the traverse and elevation mechanism shown in FIG. 50, after about a one-quarter turn from the position shown in FIG. 50.
Figure 52:
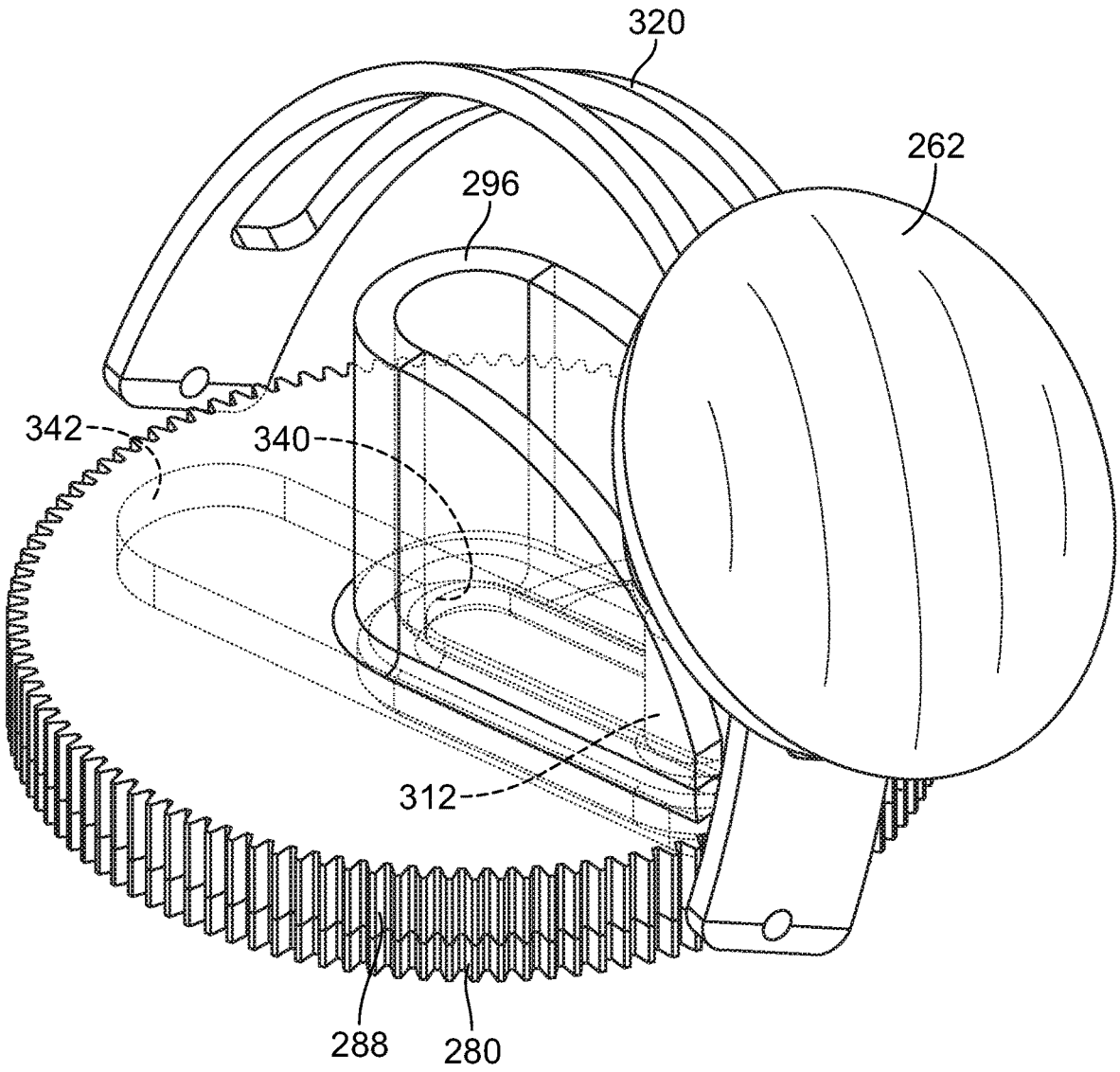
FIG. 52 is an isometric view of the portion of the traverse and elevation mechanism shown in FIGS. 50 and 51, approaching half a revolution from the position shown in FIG. 48.
Figure 53:
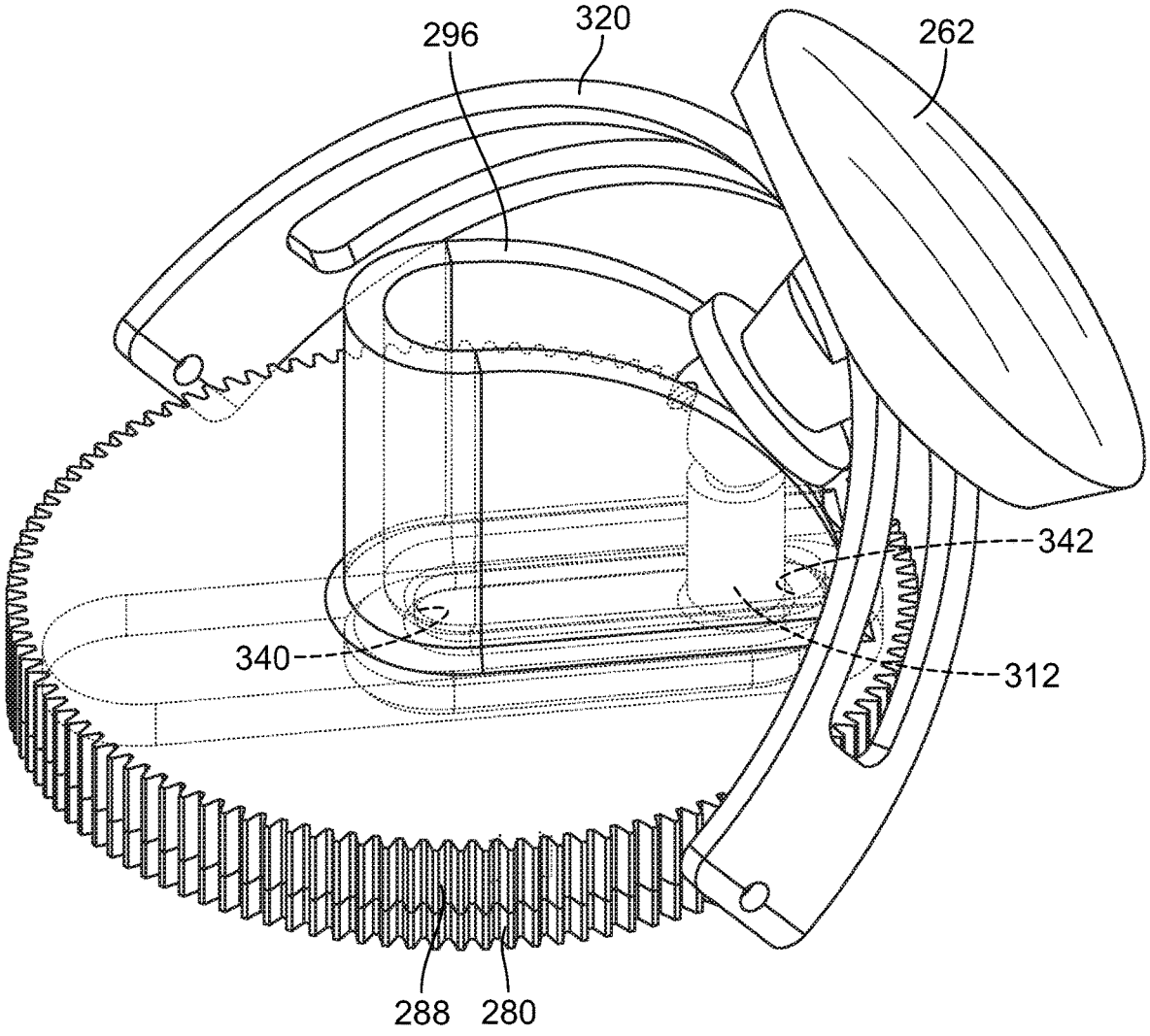
FIG. 53 is an isometric view of the portion of the traverse and elevation mechanism shown in FIGS. 50-52, slightly passed half a revolution from the position shown in FIG. 50.
Figure 54:
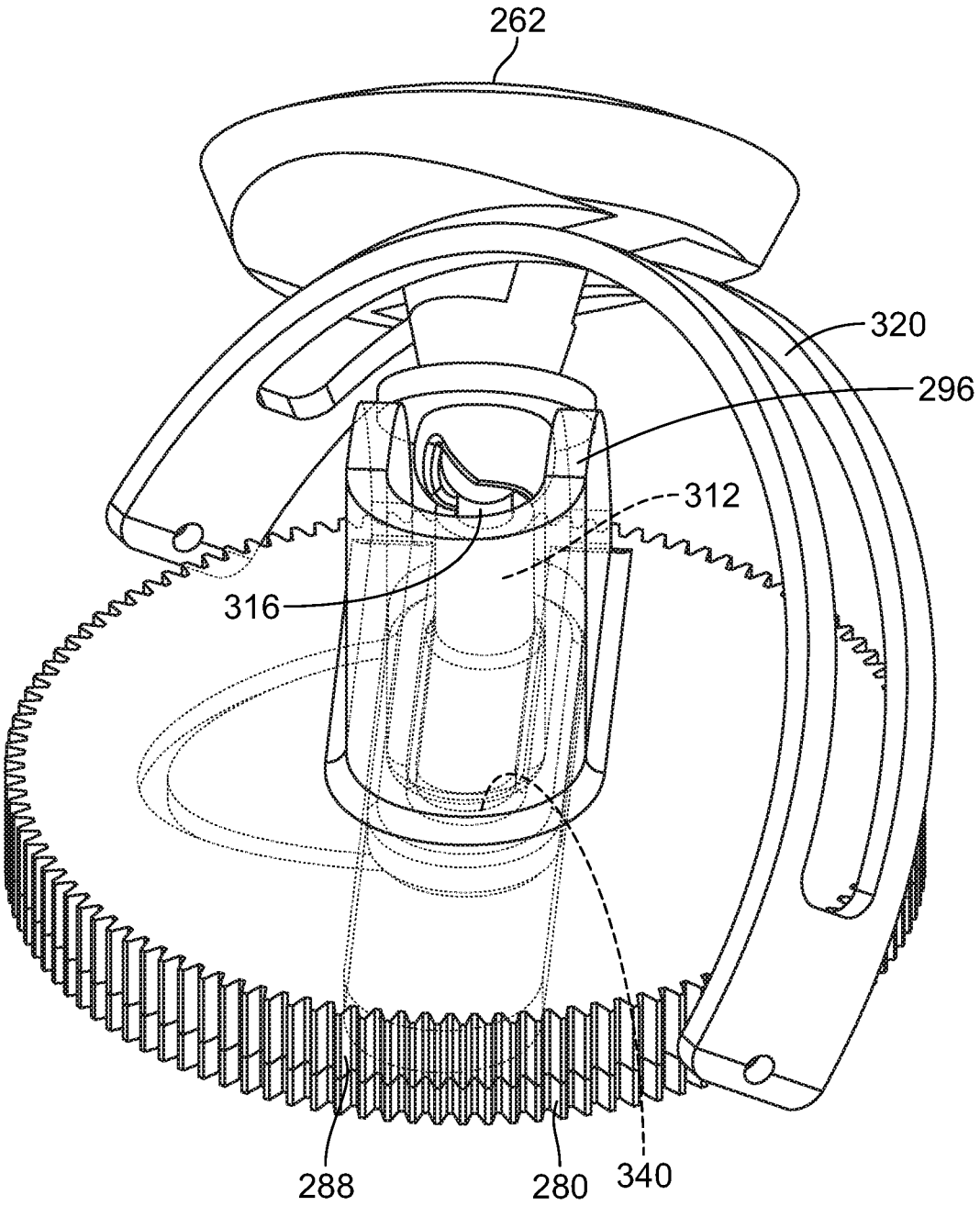
FIG. 54 is an isometric view of the portion of the traverse and elevation mechanism shown in FIGS. 50-53, after about a three-quarters turn from the position shown in FIG. 48.

The gear train 298, FIG. 33, includes a worm gear 322 extending from the reversible motor 300 on a square shaft 324, and a set of two smaller gears 328, 330 meshing with the gear teeth 282 of the lower cam 280 and the worm gear 322 when the motor rotates in a first direction. When the motor rotates in the opposite second direction, the worm gear drives a set of two larger gears 332, 334, which mesh with both of the gear teeth 282, 290, of the lower and upper cams 280, 288, respectively. When the reversible motor 300 is rotated in the first direction as shown FIG. 42, motion is transmitted to the worm gear 322 and then only to the lower cam 280 by the two smaller gears 328, 330. The smaller gears 328, 330 do not engage the upper cam 288. Hence, rotation of the upper cam 288 does not occur. However, when the reversible motor 300 is rotated in the second direction as shown in FIG. 45, motion is transmitted to the worm gear 322 and then to both of the lower and upper cams 280, 288 by the two larger gears 332, 334.

Figure 39:
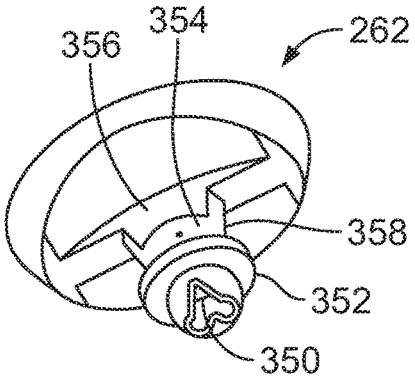
FIG. 39 is an upward looking isometric view of a dome mounting an internal magnetic element.
Figure 40:
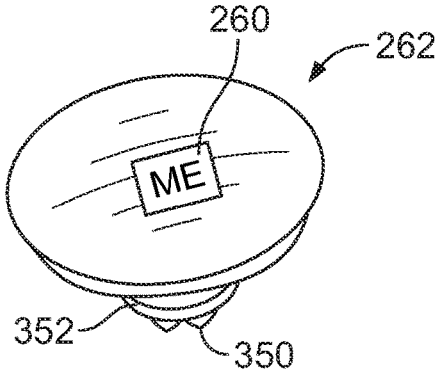
FIG. 40 is a downward looking isometric view of the dome shown in FIG. 39.

The cam follower 310, FIG. 38, may be a small post integral with the base 314, FIGS. 37 and 38, and with the sleeve 312, as shown. This configuration allows the sleeve 312 to move radially in the slot 292, FIG. 35, in the upper cam 288 while the first cam follower 310 is engaged in the groove 284 of the lower cam 280. The integral base 314 moves in the channel 297 of the upper cam 288 where the integral second cam follower 312 is bounded by the slot wall 294, FIGS. 35 and 36. The slot wall 294 includes a more centrally located end wall 340 and a more peripherally located end wall 342. The integral base, the cam follower and the sleeve may be molded from any suitable resin as may most of the other elements of the toy robot, such as the first and second cams, the gears of the transmission and the spherical housing. The linkage 316, FIG. 41, may take a cylindrical shape with a first end portion 344 that rides or slides in the opening 318 of the second cam follower 312 and a second end 346 that is ball shaped. The dome 262 and the magnetic element 260, FIGS. 39 and 40, are mounted to the ball end 346 of the linkage 316 and the dome includes a socket 350, FIG. 39, so as to form with the ball end 346, a ball joint. The ball joint allows the dome to pivot easily around the linkage 316. The dome also includes a flange 352 for riding on the guide slide 296, and a support 354 having opposite slider walls 356, 358 to enable the arcuate track 320 to support and help guide the dome. The dome is shaped to match the curvature of the interior surface 272 of the spherical housing 250. In the alternative, other dome shapes may be used, such as one that is square or rectangular in shape rather than round.

Figure 42:
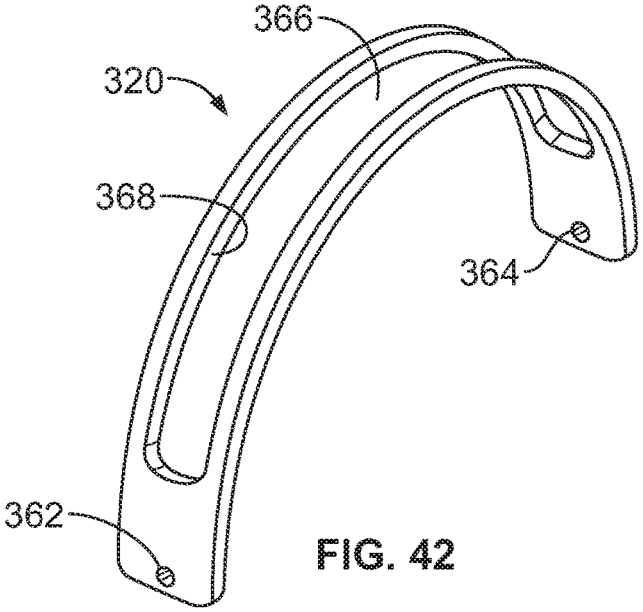
FIG. 42 is an isometric view of an arcuate track for guiding the dome with the internal magnetic element.

The arcuate track 320, FIG. 42, is pivotally mounted to the receptacle 270, FIG. 32 through openings 362, 364 and includes an arcuate slot 366 with a border wall 368. The support 354 of the dome, with opposite slider walls 356, 358, rides in the slot 366 between the sides of the wall 368 as the internal magnetic element 260 is moved by motion of the cams 280, 288. It may now be appreciated that the internal magnetic element 260 is mounted to be moved by the operator about a portion of the interior surface 272 of an upper portion of the spherical housing 250 like the region 220, FIG. 29, regardless of the orientation of the spherical housing. The drive motors 252 and the wheels 254, 256 remain in a lower portion of the spherical housing and may be operated to scoot the toy robot along a surface. Whatever movements made by the internal magnetic element 260, moreover, are followed by the external magnetic element in the appendage.

Figure 43:
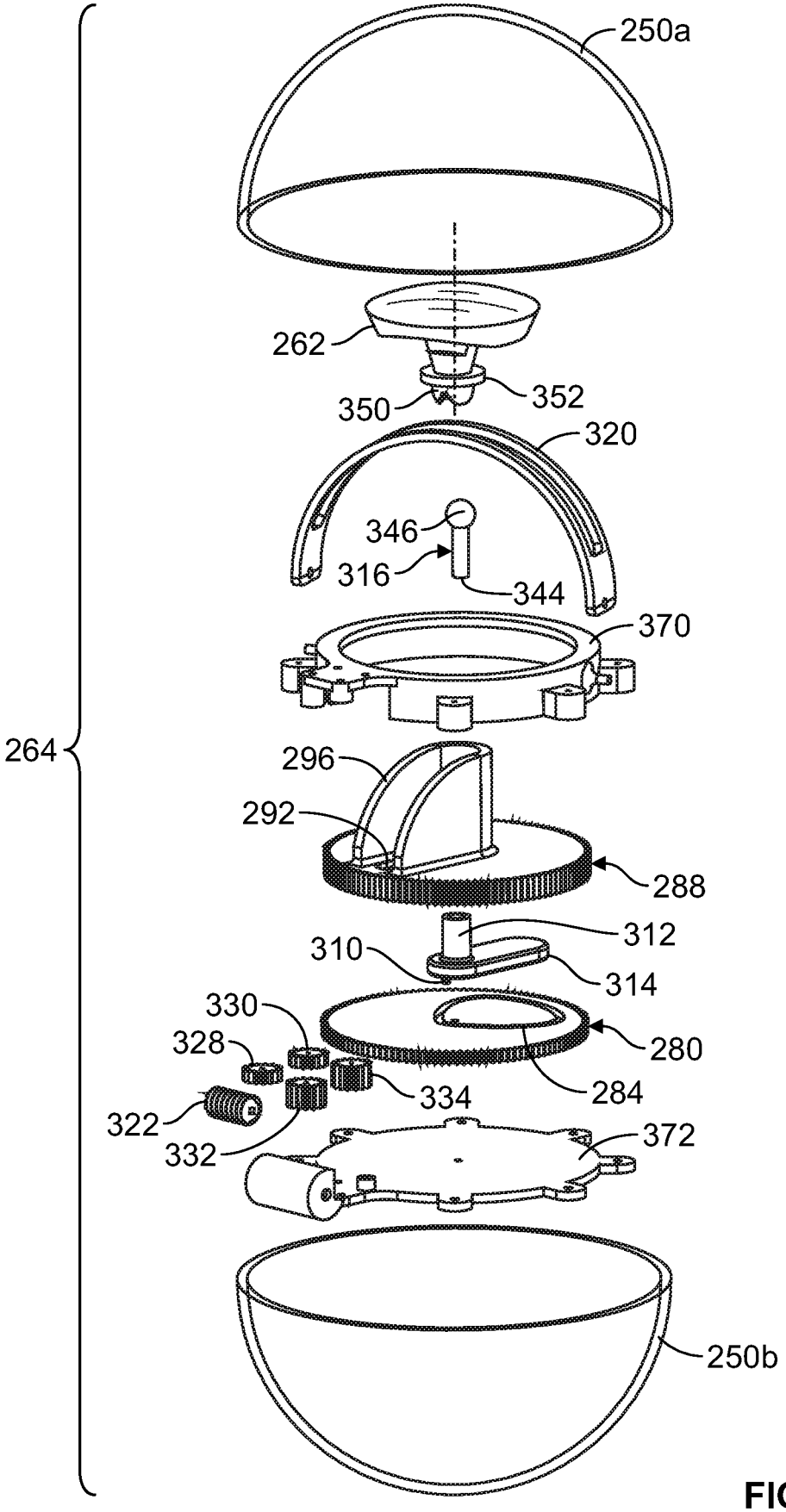
FIG. 43 is an exploded isometric view of the traverse and elevation mechanism with the spherical housing shown in FIG. 32.

Referring now to FIG. 43, an exploded view of the movement mechanism 264 and the spherical housing, and the relative positions of the various parts of the movement mechanism are illustrated. At the top of the figure is the upper portion 250*a* of the spherical body 250. Beneath the spherical housing upper portion 250*a* is the dome 262 with the internal magnetic element, followed by the arcuate track 320, and the linkage 316. The receptacle 270, including a top 370 and a plate 372, and mounts the lower and upper cams 280, 288. The upper cam 288 includes the slot 292 through which the sleeve 312 extends. The first cam follower 310 slides in the groove or raceway 284, and the sleeve 312 extends from the base 314 through the slot 292. Tangent to the lower and upper cams are the worm gear 322, the two smaller gears 328, 330 that engage the lower cam 280 only, and the two larger gears 332, 334 that engage both the lower and upper cams. Closing the spherical housing 250 is the bottom portion 250*b*.

The lower and upper cams 280, 288 rotate around their centers, and the guide slide 296, integral with the upper cam 288, rotates with the cam 288. The sleeve 312 is constrained to move radially in the slot 292 between the center end 340 and the peripheral end 342. The cam follower 310 is movable in the raceway 284 of the lower cam 280. An end 344 of the linkage 316 telescopes within the sleeve 312 and follows the radial movement of the sleeve generally moving between the position shown in FIG. 44, and the position shown in FIG. 45.

It is important to note that only a single motor controls the movement mechanism 264. One cam controls the radial position of the internal magnetic element and both cams control the sweep of the internal magnetic element. In order to control these cams, the single motor spins in first direction to control one cam and the radial variable, and when the motor spins in the opposite second direction the scope of the sweep of the internal magnetic element is controlled. Thus, the mechanism is compact, lightweight, simply constructed, inexpensive and yet, robust and efficient.

The limits of actual movement of the illustrated movement mechanism are shown generally in FIGS. 46-54. At one limit, shown in FIGS. 46-49, where the operator has selected a radius for the positions of the sleeve, the linkage and the internal magnetic element near the centers of the cams, and the sleeve 312 is located at the center end 340 of the slot 292. Thereafter, rotation of the cams shows a very limited sweep of the internal magnetic element when viewed approximately every quarter turn from a position where a longitudinal axis 380 of the sleeve, the linkage, and the internal magnetic element are positioned approximately perpendicular relative to the rotational planes of the cams.

At the opposite limit shown in FIGS. 50-54, where the operator has selected a radial position for the internal magnetic element at the peripheral end 342 of the slot 292, and the longitudinal axis 380 of the internal magnetic element assumes a full tilt position. The slope of the inner surface of the spherical housing causes the linkage to recede into the opening of the sleeve as the internal magnetic element adjusts to the distance of the interior surface of the spherical housing. Thus, the internal magnetic element is capable of a sweep of the interior surface of the spherical housing as depicted in the crosshatch pattern 220, FIG. 29. It is noted that the orientation of the spherical housing is of no concern because the crosshatch region remains the same relative to the spherical housing even if the spherical housing is rolling at the same time as the reversible motor is activated.

Figure 55:
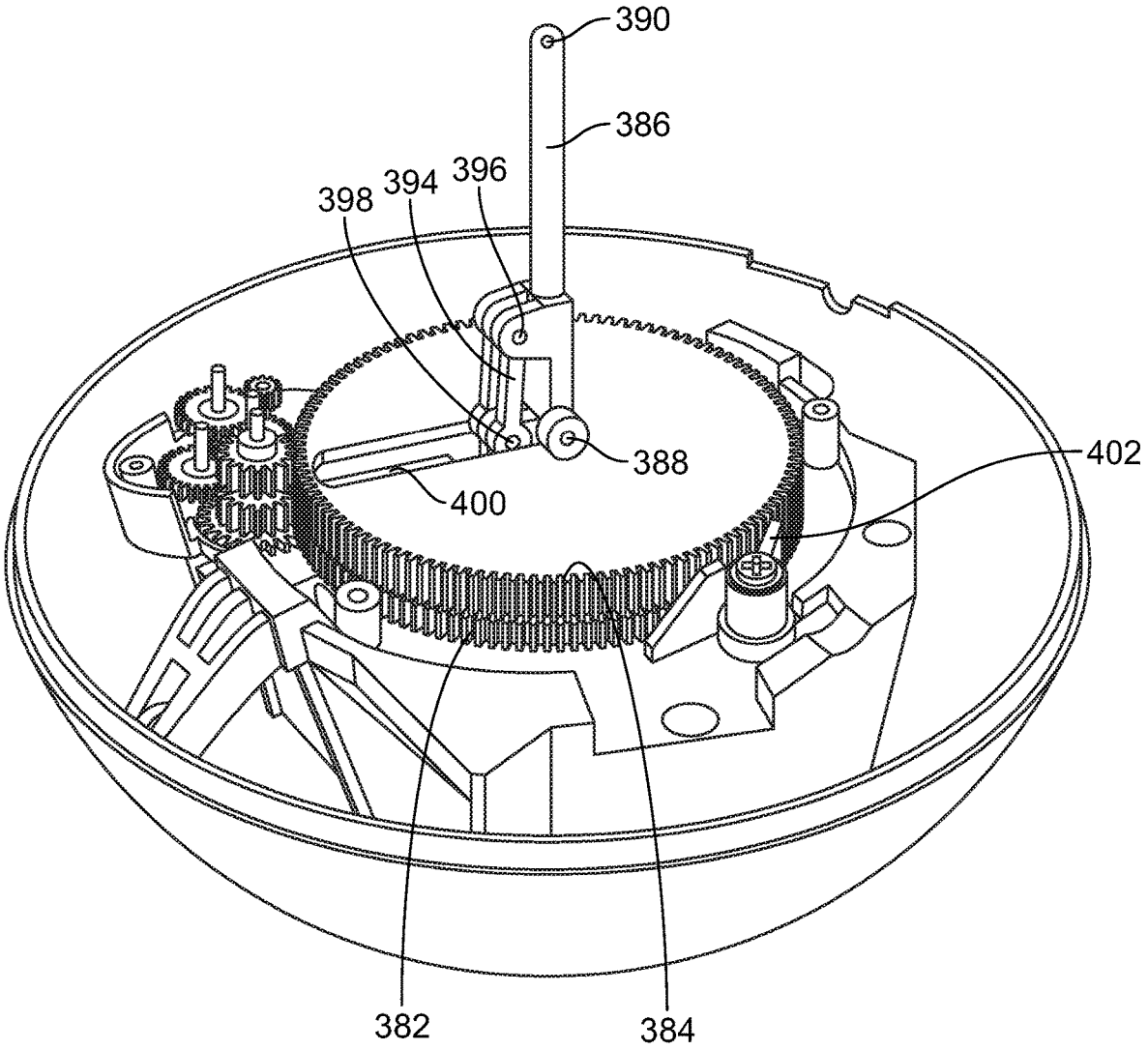
FIG. 55 is an isometric view of yet another embodiment of a partial traverse and elevation mechanism, absent an internal magnetic element and a dome.
Figure 56:
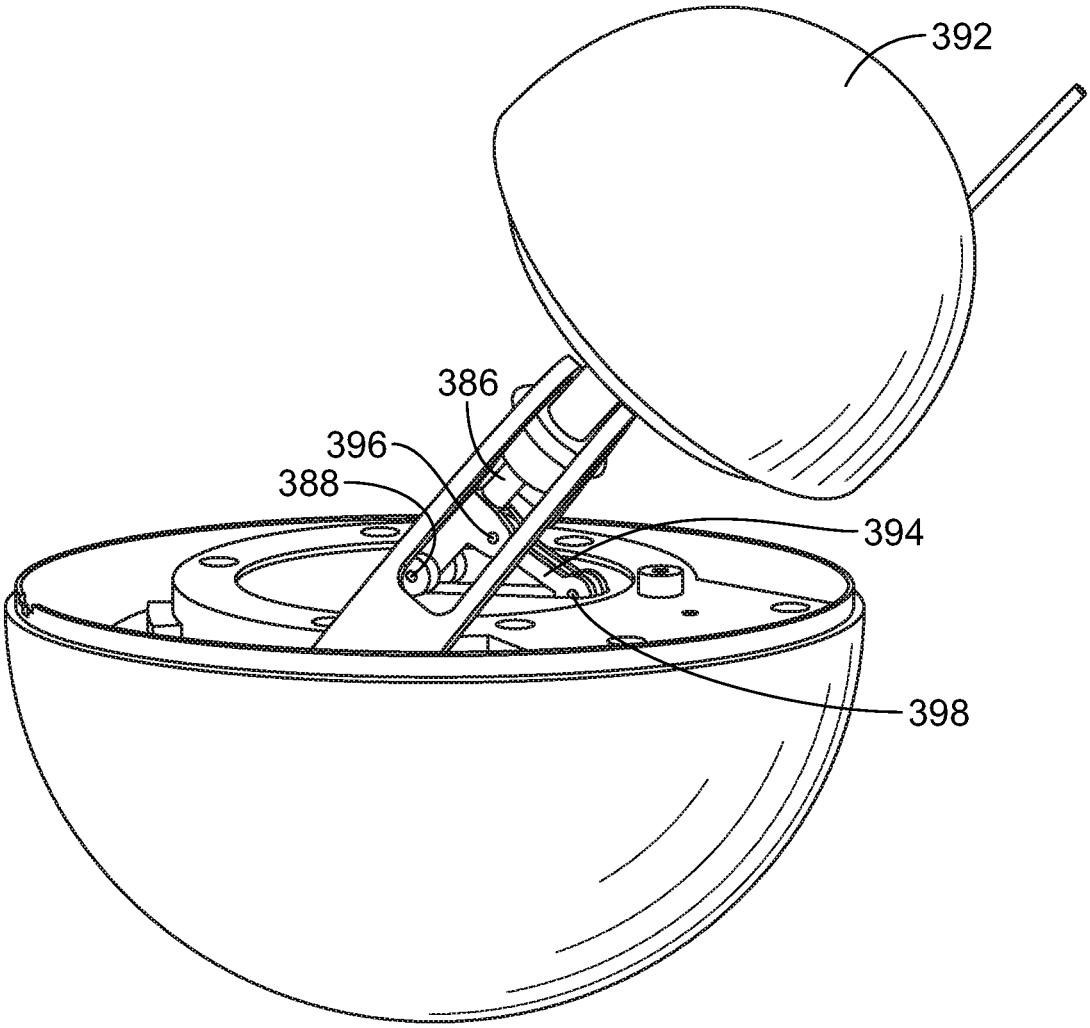
FIG. 56 is an isometric view of the embodiment of the partial traverse and elevation mechanism shown in FIG. 55, including an appendage and absent an interposed upper half of the spherical housing.

Yet another embodiment of the present invention is illustrated in FIGS. 55 and 56, where first and second rotatable cams 382, 384 are essentially the same as the first and second rotatable cams 80, 82. The linkage used includes a long link 386 pivotally mounted at one end 388 to the upper cam 384 and at an opposite end 390 to an internal magnetic element, which is removed in FIG. 55, and is covered by an appendage 392 in FIG. 56. (The upper portion of the spherical housing has been removed in both FIGS. 55 and 56, although normally the spherical housing would be between the internal magnetic element and the appendage 392.) A short link 394 is pivotally connected to the long link 386 at one end 396 and pivotally connected to a base (not shown, but similar to the base 112) at an opposite end 398 where the base is slidable beneath a slot 400 to change the angle of elevation of the internal magnetic element. In FIG. 55, the linkage is shown at one limit (radius at 0) where the long link 386, and thus the internal magnetic element, is approximately perpendicular to the first and second rotatable cams 380, 382. In FIG. 56, the radius is positioned at the opposite limit resulting in the internal magnetic element being positioned at full tilt. A ratchet 402 is provided to prevent two-way rotation of the upper cam 384.

Figure 57:
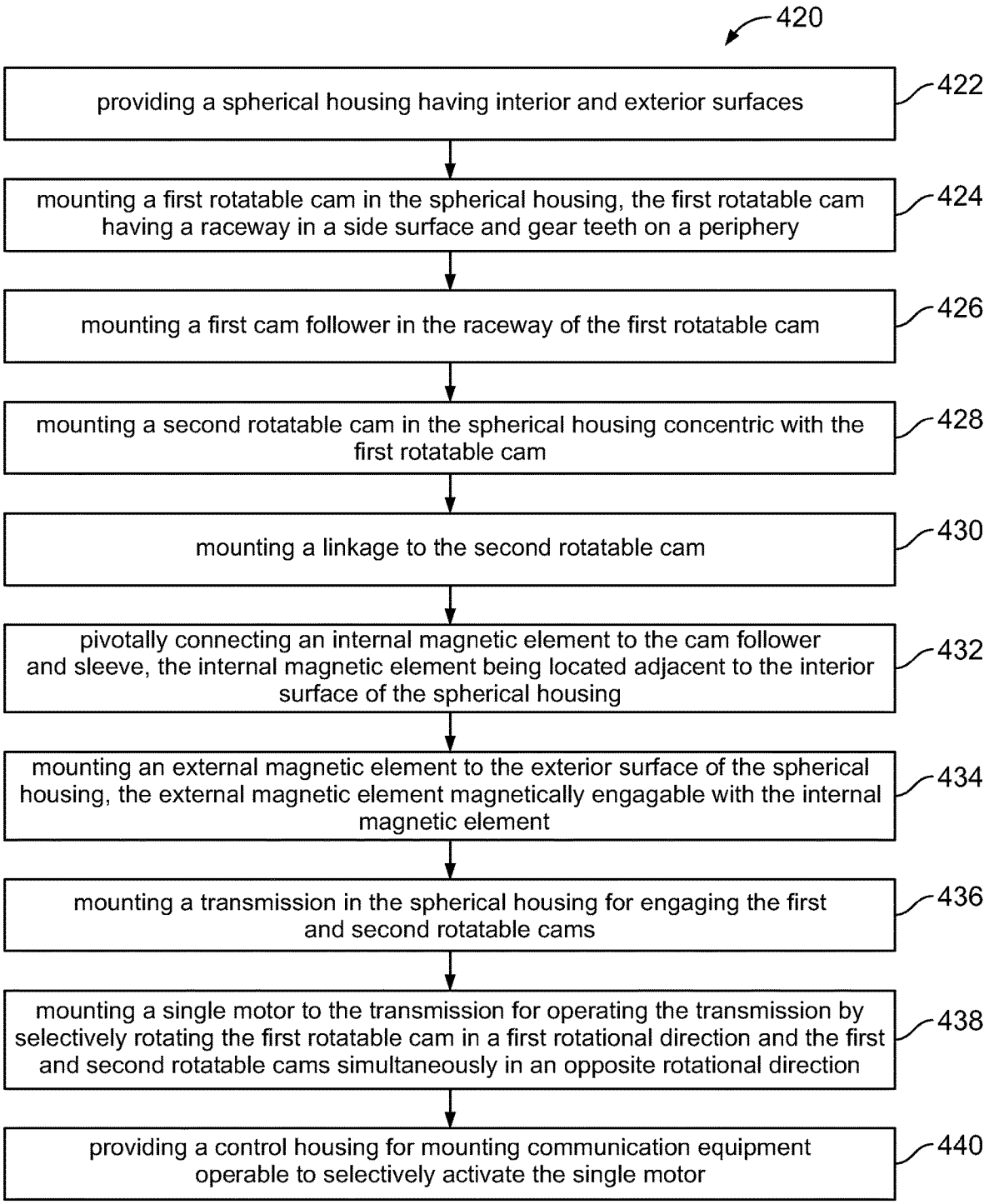
FIG. 57 is a flow diagram of a method for assembling a toy robot.

The present invention also includes a method 420, FIG. 57, for assembling a toy robot including the steps of providing a spherical housing having interior and exterior surfaces 422, mounting a first rotatable cam in the spherical housing, the first rotatable cam having a raceway in a side surface and gear teeth on a periphery 424, mounting a cam follower in the raceway of the first rotatable cam 426, mounting a second rotatable cam in the spherical housing concentric with the first rotatable cam 428, mounting a linkage including a sleeve to the second rotatable cam 430, pivotally connecting an internal magnetic element to the cam follower and sleeve, the internal magnetic element being located adjacent to the interior surface of the spherical housing 432, mounting an external magnetic element to the exterior surface of the spherical housing, the external magnetic element magnetically engagable with the internal magnetic element 434, mounting a transmission in the spherical housing for engaging the first and second rotatable cams 436, mounting a single motor to the transmission for operating the transmission by selectively rotating the first rotatable cam in a first rotational direction and the first and second rotatable cams simultaneously in an opposite rotational direction 438, and providing a control housing for mounting communication equipment operable to selectively activate the single motor 440.

It may now be appreciated that the toy robot disclosed in detail above has great play value, is fun to use and easy to operate. The traverse and elevation mechanism in the robot is compact, lightweight and robust, and yet has a simple structure that may be produced at reasonable cost.

From the foregoing, it can be seen that there has been provided features for an improved traverse and elevation mechanism and for a toy robot using the traverse and elevation mechanism, and a disclosure of a method for assembling the toy robot. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A traverse and elevation mechanism comprising:

a first rotatable cam mounted in a housing;

a second rotatable cam mounted in the housing concentric with the first rotatable cam;

a cam follower operatively connected to the first rotatable cam;

a structural element mounted to the cams radially and angularly adjustable by selective movements of the cams;

a transmission mounted in the housing, the transmission for selectively engaging the first and second rotatable cams to enable the first and second rotatable cams to rotate;

a single reversible motor connected to the rotatable cams through the transmission for selectively rotating one cam in a first directions and both cams in a second direction;

a control housing for mounting communication equipment operable to selectively activate the motor;

wherein the housing is enabled to roll; and wherein the structural element includes a first magnetic element mounted in the housing for attracting a second magnetic element located outside of the housing.

2. The mechanism as claimed in claim 1, wherein:

the first rotatable cam includes a groove for receiving the cam follower.

3. The mechanism as claimed in claim 2, wherein:

the second rotatable cam includes a radially disposed slot.

4. The mechanism as claimed in claim 3, wherein:

the structural element is movable in the slot of the second rotatable cam.

5. The mechanism as claimed in claim 1, wherein:

a radial position of the structural element in the housing is adjustable by rotating the first rotatable cam in the first direction.

6. The mechanism as claimed in claim 1, wherein:

movement of the structural element in the housing is adjustable by rotating the first and the second cams in the second direction opposite the first direction.

7. The mechanism as claimed in claim 1, wherein:

the first rotatable cam includes a groove for receiving the first cam follower;

the second rotatable cam includes a radially disposed slot;

the structural element is movable in the slot of the second rotatable cam;

the housing is enabled to roll;

the structural element includes a first magnetic element mounted in the housing for attracting a second magnetic element located outside of the housing;

a radial position of the first magnetic element in the housing is adjustable by rotating the first rotatable cam in the first direction; and an angular position of the first magnetic element in the housing is adjustable by rotating the first and the second cams in a second direction opposite the first direction.

8. The mechanism as claimed in claim 1, wherein the second rotatable cam includes a radially disposed slot, and the structural element is movable in the slot of the second rotatable cam.

9. A toy robot apparatus comprising:

a spherical housing having interior and exterior surfaces;

a first rotatable cam mounted in the housing, the first rotatable cam having a raceway in a side surface;

a cam follower operatively mounted to the raceway of the first rotatable cam;

a second rotatable cam mounted in the housing concentric with the first rotatable cam, the second rotatable cam having a radially directed slot;

a structural element mounted to move in the slot, the structural element including an internal magnetic element pivotally mounted and located adjacent to the interior surface of the housing;

the structural element including a linkage connecting the first and second cams and the internal magnetic element;

an arcuate track mounted within the spherical housing for supporting the internal magnetic element;

a transmission mounted in the spherical housing, the transmission engaging the first and second cams for selectively rotating the first and second cams; and a single reversible motor for operating the transmission by selectively rotating in a first direction and in a second direction, with a radial position of the internal magnetic element in the spherical housing adjustable by rotating the first rotatable cam in the first direction.

10. The apparatus as claimed in claim 9, further comprising:

an external magnetic element movable along the exterior surface of the spherical housing magnetically attracted to the internal magnetic element wherein movement of the internal magnetic element along the interior surface of the spherical housing causes movement of the external magnetic element about the exterior surface of the spherical housing; and a control housing for mounting communication equipment operable to selectively activate the reversible motor.

11. The apparatus claimed in claim 10, including:

a drive apparatus mounted in the spherical housing for moving the spherical housing: and wherein the communication equipment controls the drive apparatus.

12. The apparatus claimed in claim 10, including:

a spring operately connected to the arcuate track for facilitating control of the external magnetic element.

13. The apparatus claimed in claim 10, wherein:

the first cam includes peripheral gear teeth;

the second cam includes peripheral gear teeth;

the linkage in mounted to the second cam;

a radial position of the internal magnetic element in the spherical housing is adjustable by rotating the first rotatable cam in the first direction; and sweep of the internal magnetic element in the spherical housing is adjustable by rotating both of the first and the second cams in a second direction opposite the first direction.

14. The apparatus claimed in claim 9, wherein:

the first cam includes peripheral gear teeth; and the second cam includes peripheral gear teeth.

15. The apparatus claimed in claim 9, wherein:

the linkage is mounted to the second cam.

16. The apparatus as claimed in claim 9, wherein:

sweep of the internal magnetic element in the spherical housing is adjustable by rotating both of the first and the second cams in a second direction opposite the first direction.

17. A method for assembling a toy robot comprising the steps of:

providing a spherical housing having interior and exterior surfaces;

mounting a first rotatable cam in the spherical housing, the first rotatable cam having a raceway in a side surface and gear teeth on a periphery;

mounting a cam follower in the raceway of the first rotatable cam;

mounting a second rotatable cam in the spherical housing concentric with the first rotatable cam;

pivotally connecting an internal magnetic element to the first and second cam followers, the internal magnetic element being located adjacent to the interior surface of the spherical housing;

providing an external magnetic element for mounting to the exterior surface of the spherical housing, the external magnetic element being enabled to magnetically engage with the internal magnetic element;

mounting a transmission in the spherical housing for engaging the first and second rotatable cams;

mounting a single motor to the transmission for operating the transmission by selectively rotating the first rotatable cam in a first rotational direction and rotating both of the first and second rotatable cams simultaneously in an opposite second rotational direction; and providing a control housing for mounting communication equipment operable to selectively activate the single motor.

18. The method of claim 17, including the steps of:

forming a radial slot in the second cam;

mounting a linkage to move in the slot for determining a radial position of the internal magnetic element by rotating the first rotatable cam in the first rotational direction and maintaining the second rotatable cam in a stationary position; and mounting the internal magnetic element to enable a sweep of a predetermined region to be adjusted by rotating both of the first and second rotatable cams simultaneously in the opposite rotational direction of the rotation of the first rotatable cam when moved alone.

19. The method of claim 18, including the steps of:

mounting a receptacle in the spherical housing;

mounting a drive apparatus in the receptacle for moving the spherical housing; and supporting the cams, the cam follower and the internal magnetic element with the receptacle.

20. The method of claim 19, including the step:

mounting communication equipment in the control housing to operate the drive apparatus and the single motor.

* * * * *